US011764025B2

(12) United States Patent
Ehrhardt et al.

(10) Patent No.: US 11,764,025 B2
(45) Date of Patent: Sep. 19, 2023

(54) TRIGGERED FUSE FOR LOW-VOLTAGE APPLICATIONS

(71) Applicant: DEHN SE, Neumarkt i.d.O.pf. (DE)

(72) Inventors: Arnd Ehrhardt, Neumarkt/Opf. (DE); Peter Zahlmann, Neumarkt (DE); Sven Wolfram, Ilmenau (DE)

(73) Assignee: DEHN SE, Neumarkt i.d. OPf. (DE)

( * ) Notice: Subject to any disclaimer, the term of this patent is extended or adjusted under 35 U.S.C. 154(b) by 0 days.

(21) Appl. No.: 17/485,963

(22) Filed: Sep. 27, 2021

(65) Prior Publication Data

US 2022/0013320 A1 Jan. 13, 2022

Related U.S. Application Data

(63) Continuation of application No. 16/478,207, filed as application No. PCT/EP2018/051491 on Jan. 23, 2018, now Pat. No. 11,201,027.

(30) Foreign Application Priority Data

Feb. 1, 2017 (DE) ..... 102017101985.5
Aug. 23, 2017 (DE) ..... 102017119285.9

(51) Int. Cl.
*H01H 89/00* (2006.01)
*H01H 39/00* (2006.01)
(Continued)

(52) U.S. Cl.
CPC ..... *H01H 89/00* (2013.01); *H01H 39/006* (2013.01); *H01H 85/0039* (2013.01); *H01H 85/12* (2013.01); *H01H 85/185* (2013.01)

(58) Field of Classification Search
CPC .. H01H 89/00; H01H 39/006; H01H 85/0039; H01H 85/12; H01H 85/185;
(Continued)

(56) References Cited

U.S. PATENT DOCUMENTS 1,761,760 A 6/1930 Van Der Bogart ..... 337/157
2,400,408 A 5/1946 Haefelfinger ..... 337/17
(Continued)

FOREIGN PATENT DOCUMENTS

CH 410137 A 3/1966 ..... H01H 85/38
DE 4211079 A1 10/1993 ..... H01H 39/00
(Continued)

OTHER PUBLICATIONS

The Notification Concerning Transmittal of International Preliminary Report on Patentability (Chapter I of the Patent Cooperation Treaty), in English, dated Aug. 15, 2019, which was issued by the International Bureau of WIPO in Applicant's corresponding international PCT application having Serial No. PCT/EP2018/051491, filed on Jan. 23, 2018.

(Continued)

*Primary Examiner* — Thienvu V Tran
*Assistant Examiner* — Sreeya Sreevatsa
(74) *Attorney, Agent, or Firm* — Bodner & O'Rourke, LLP; Gerald T. Bodner; Christian P. Bodner

(57) ABSTRACT

The invention relates to a triggered fuse for low-voltage applications for protecting devices that can be connected to a power supply system, in particular surge protection devices, consisting of at least one fusible conductor which is located between two contacts and is arranged in a housing, and also consisting of a trigger device for controlled disconnection of the fusible conductor in the event of malfunctions or overload states of the respective connected device, wherein an arc quenching medium is introduced into the housing. The at least one fusible conductor has a plurality of conventional electrical bottlenecks, which are designed for the rated load of the respective fuse. At least one further additional geometric bottleneck is provided, which is dis-
(Continued)

Figure 1:
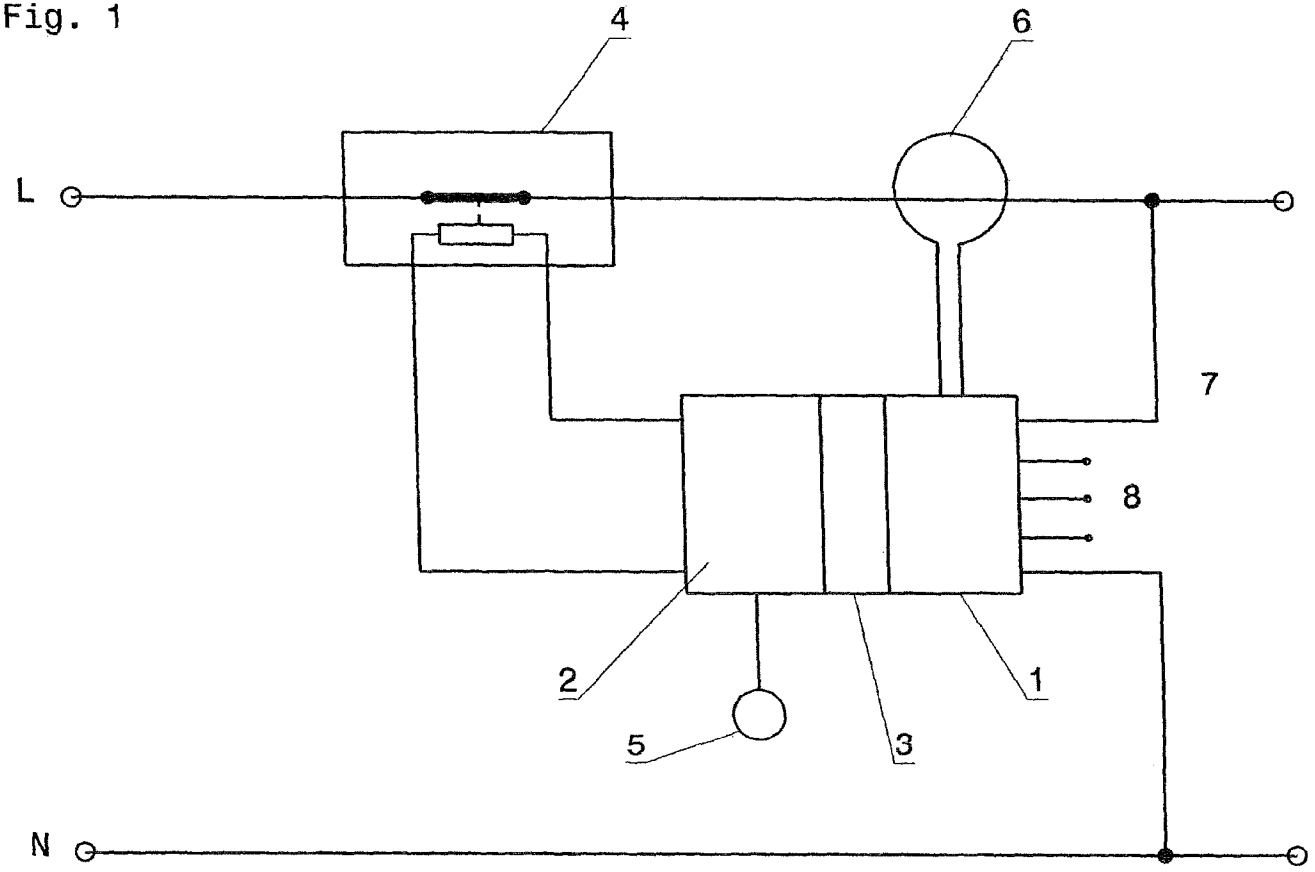

connectable by rupturing depending on the trigger unit when applied by tension.

21 Claims, 28 Drawing Sheets

(51) Int. Cl.
*H01H 85/00* (2006.01)
*H01H 85/12* (2006.01)
*H01H 85/18* (2006.01)

(58) Field of Classification Search
CPC ..... H01H 85/38; H01H 85/36; H01H 85/10; H01H 85/18; H01H 9/36; H01H 2085/381
USPC ..... 361/2
See application file for complete search history.

(56) References Cited

U.S. PATENT DOCUMENTS

| | | | | |
|---|---|---|---|---|
| 3,040,660 | A | 6/1962 | Johnston | 102/206 |
| 3,179,851 | A | 4/1965 | Smith, Jr. | 361/124 |
| 3,256,408 | A | 6/1966 | Stumpe et al. | 337/273 |
| 4,041,435 | A | 8/1977 | Gaia | 337/159 |
| 4,486,734 | A * | 12/1984 | Leach | H01H 85/042 337/160 |
| 4,559,513 | A | 12/1985 | Gaia | 337/165 |
| 5,077,534 | A | 12/1991 | Douglass | 337/164 |
| 6,556,119 | B1 * | 4/2003 | Lell | H01H 37/323 337/182 |
| 7,123,124 | B2 * | 10/2006 | Caruso | H01H 39/006 200/61.08 |
| 10,134,555 | B2 | 11/2018 | Durth | |
| 10,388,481 | B2 | 8/2019 | Lell | |
| 2016/0268089 | A1 | 9/2016 | Schlaak et al. | |

FOREIGN PATENT DOCUMENTS

| | | | | |
|---|---|---|---|---|
| DE | 102008047256 | A1 | 3/2010 | H01H 39/00 |
| DE | 102014115396 | A1 | 12/2014 | H01H 1/66 |
| DE | 102014205871 | A1 * | 10/2015 | H01H 85/06 |
| DE | 102015114279 | A1 | 10/2015 | H01H 39/00 |
| DE | 102014215279 | A1 | 2/2016 | H01H 85/38 |
| DE | 102015112141 | A1 * | 1/2017 | H01H 39/006 |
| DE | 102015112141 | A1 | 1/2017 | H01H 39/00 |
| EP | 0563947 | A1 | 10/1993 | H01H 39/00 |
| JP | S6081729 | A | 5/1985 | H01H 37/76 |
| JP | 2014049272 | A | 3/2014 | H01H 85/02 |
| WO | WO9741581 | A1 | 11/1997 | H01H 39/00 |
| WO | WO2014158328 | A1 | 10/2014 | H01F 38/00 |

OTHER PUBLICATIONS

The English translation of the International Preliminary Report on Patentability (Chapter I of the Patent Cooperation Treaty), dated Aug. 6, 2019, which was issued by the International Bureau of WIPO in Applicant's corresponding international PCT application having Serial No. PCT/EP2018/051491, filed on Jan. 23, 2018.

The Written Opinion of the International Searching Authority, in English, dated Apr. 3, 2018, which was issued by the International Bureau of WIPO in Applicant's corresponding international PCT application having Serial No. PCT/EP2018/051491, filed on Jan. 23, 2018.

The International Search Report, in English, dated Apr. 3, 2018, which was issued by the International Bureau of WIPO in Applicant's corresponding international PCT application having Serial No. PCT/EP2018/051491, filed on Jan. 23, 2018.

* cited by examiner

TRIGGERED FUSE FOR LOW-VOLTAGE APPLICATIONS

CROSS-REFERENCE TO RELATED APPLICATIONS

This application is a continuation of co-pending U.S. patent application Ser. No. 16/478,207, filed on Jul. 16, 2019, and entitled, "Triggered Fuse For Low-Voltage Applications", which claims the benefit of priority, under 35 U.S.C. 371, to international PCT Application Serial No. PCT/EP2018/051491, filed on Jan. 23, 2018, which in turn claims priority to German Patent Application Serial No. 10 2017 101 985.5, filed on Feb. 1, 2017, and German Patent Application Serial No. 10 2017 119 285.9, filed on Aug. 23, 2017, the disclosure of each of which is hereby incorporated by reference and on which priority is hereby claimed.

The invention relates to a triggerable melting fuse for low-voltage applications for protecting devices that can be connected to a power supply system, in particular surge protection devices, consisting of at least one fusible conductor which is located between two contacts and is arranged in a housing, and also consisting of a trigger device for controlled disconnection of the fusible conductor in the event of malfunctions or overload states of the respective connected device, wherein an extinguishing medium is introduced into the housing.

Conventional melting fuses are employed in great numbers and in many cases of application in order to guarantee overcurrent or short-circuit protection for cables and lines but also for connected equipment.

Furthermore, fuses are used as a backup protection for surge arresters in the so-called shunt arm. Here, a corresponding fuse must guarantee the protection in case of a short-circuit.

Due to the increasing use and integration of regenerative energy sources in supply networks, volatile short-circuit values increasingly appear at the installation sites of the equipment depending on the feed-in situation. This may entail the consequence that the required melting or cut-off integrals of the fuses must be varied over a wide range. In certain circumstances, the selected fuse may no longer guarantee the protection under all conceivable feed-in conditions. Basically, the use of circuit breakers having triggering characteristics is an alternative here, but these switches are significantly more expensive than fuses and are not suitable in this respect for all applications for reasons of cost.

The special properties of a melting fuse basically allow only very small design options with respect to varying or setting the protective range of the fuse.

To be able to adapt and enlarge the range of application of fuses, it has already been proposed to disconnect the current conductor of an electric fuse element by means of a pyrotechnically driven disconnector. DE 42 11 079 A1 shows such a solution, in which a pyrotechnic charge is detonated when the current which flows through the current conductor of the fuses and is detected by a current detection device exhibits an intensity which is greater than a predefinable threshold value.

DE 10 2008 047 256 A1 discloses a high-voltage fuse with a controllable drive for a shearing rod which destroys a plurality of bottlenecks. The control may thereby be performed depending on a fault current from a separate control unit.

DE 10 2014 215 279 A1 discloses a melting fuse for a device to be protected which is connected in series with the melting fuse.

With regard to dimensioning of melting fuses, DE 10 2014 215 279 A1 refers to the melting integral $I^2t$. According to this, the melting of a fusible conductor is determined by its material and geometry properties, so that, depending on the material and/or geometry of the fusible conductor, a respective heat amount Q is necessary for evaporating the fusible conductor.

Special requirements apply in the case where the device to be protected by the fuse is a surge voltage protection device, since this surge voltage protection device should allow high currents to pass for a short time, without the melting fuse triggering, but at the same time also prematurely disconnect in case of fault currents of short duration which can occur, for example, upon damage of the surge voltage protection device or as a power follow current. The first of the mentioned requirements frequently leads to high rated current values of the fuse. The second requirement of the mentioned requirements may only be realized reasonably at low nominal current values.

Taking account of these problems, DE 10 2014 215 279 A1 refers to a further development of a melting fuse in such a manner that additional contacts are provided, wherein one of the additional contacts represents a trigger contact, in order to cause the fusible conductor to melt indirectly of directly by initiating a short-circuit. Furthermore, the fusible conductor may have a predetermined breaking point in the area of one of the further contacts. In one embodiment, the fusible conductor is surrounded by an extinguishing medium at least in sections, in particular by sand. With regard to the state of the art, reference should also be made to CH 410137 A, U.S. Pat. No. 2,400,408 A, and WO 2014/158328 A1.

From the aforementioned, it is the task of the invention to propose a further developed triggerable melting fuse for low-voltage applications for protecting devices that can be connected to a power supply system, in particular surge protection devices, wherein the fuse, in addition to the melting integral value relative to the fuse rating, may be triggered in a targeted manner as required and depending on currents to be expected, in particular short-circuit currents. In this case, reference should be made to a destruction known per se of the fusible conductor by the effect of mechanical forces.

The triggering, that is to say the control for disconnecting the fusible conductor in the event of malfunction, should either be assumed by a superordinate control unit, or in case the fuse is integrated as a backup protection in surge voltage protection devices, by the surge voltage protection device. The triggerable melting fuse should furthermore be capable of triggering on the basis of measured mains impedance values.

The configuration of the fuse to be created should be cost-effective, the fuse should have a high switching capacity and a small design. By specifying values for forming additional bottlenecks, the option of a fuse protection characteristic that can be set in a targeted manner can be realized.

The solution of the task of the invention is performed by the features of the independent claims, the subclaims comprising at least appropriate configurations and further developments.

For solving the task, reference is accordingly made to a triggerable melting fuse which is in particular suitable for low-voltage applications for protecting devices that can be connected to a power supply system, in particular surge protection devices. The melting fuse consists of at least one fusible conductor which is located between two contacts and is arranged in a housing. Furthermore, a trigger device for controlled disconnection of the fusible conductor in the event of malfunctions or overload states of the respective connected device is provided, wherein an extinguishing medium is introduced into the housing.

The fuse according to the invention disposes of at least one fusible conductor having a plurality of bottlenecks in series, whereby the passive function of a usual electrical NH fuse is guaranteed. In addition, the fuse exhibits per fusible conductor at least one additional special bottleneck which does not impair the passive function of the fuse, and which can be actuated by triggering independently of the electric current load. This special bottleneck will be destroyed by mechanical breaking, cutting, punching, or punching out or disconnecting a solder connection.

According to an inventive idea, an extinguishing medium-free region is formed in the housing such that the at least one fusible conductor is exposed in at least one section.

Via an access in the housing, a mechanical separating element can be introduced into the extinguishing medium-free region in order to mechanically destroy the at least one fusible conductor depending on the trigger device, and independently of its melting integral.

In one embodiment of the invention, the separating element is formed as a blade or cutting edge.

The separating element itself can be driven toward the fusible conductor by a bridge igniter.

The mechanical energy for moving the separating element may likewise be provided by a shape memory alloy or other shape or volume changing media.

The trigger device comprises a detection end evaluation unit, as well as a control for the exemplary bridge igniter and an energy supply and has at least one control input.

By means of the detection and evaluation unit, the passive characteristic of the fusible conductor of the fuse may be interrupted at any time, about >10 ms. Solely the range of the adiabatic melting remains unaffected. The $I^2t$ value related thereto is matched in a known way to the load to be protected via the dimensioning of the fusible conductor.

The solution according to the invention also enables the interruption of very small currents far below the passive rated current of the fusible conductor, as well as a current-free interruption. Due to this, an interruption may even be performed independently of the current flow, for example, already upon a measured impedance change.

Due to the continuous measuring and when configured as an adaptive system, the evaluation and detection unit can take into account changes in the network when defining the instantaneous protection characteristic. This is advantageous in case of a varying number of loads or a varying power supply capacity by energy producers.

Known basic functions for triggering, such as current, voltage, the increases thereof, or even the time-dependent behavior thereof, but also external control signals may be utilized for controlling the trigger function apart from the impedance evaluation. When surge protection devices are protected, voltage time areas, and in combination with current evaluation, temporal developments of the performance or of the energy turnover may also be utilized as trigger criteria.

Criteria such as pressure, temperature, light, magnetic fields, electric fields or similar may be fed and considered via further sensors at additional inputs.

As set forth, the triggerable melting fuse according to the invention is in particular suitable as an arrester backup fuse for a series connection to surge arresters in the field of low-voltage applications.

In this case, the fuse according to the invention is in particular formed for the application with spark gaps and can be configured according to these specific features. Basically, the proposed principle is suitable both for direct current applications and alternating current applications and also allows to be utilized in the series arm, for example.

Due to the small design, the controllable fuse may be used in a common housing of a surge protection device connected in series with a spark gap or a varistor.

The fuse protects the surge protection device before, at, or, if necessary, even after an overloading and disconnects it from the network.

According to a further basic idea of the inventive teaching, a triggerable fuse is proposed, which aims at a defined mechanical cutting of a special, additional bottleneck of a fusible conductor of a fuse after a trigger has been actuated.

According to the invention, a constructive coordination of the additional bottleneck to already existing passive current bottlenecks, that is to say classical fuse bottlenecks, is performed. Quartz sand, for example, is suitable as an extinguishing medium, in particular in case of high switching capacities.

By the variant described below, the task is solved to create a fuse, which combines the advantages of a classical current-limiting fuse with those of an activatable, quasi intelligent fuse with just one cutting edge in a small design and a simple activator. In a passive function, the fuse does not lead to an increase of the protective level of the downstream arranged arrester, and, when activated, does not generate any voltage above the identified protective level of the respective connected surge protection device.

The relevant solution is based on one or more parallel fusible conductors of the fuse, which are arranged within an extinguishing medium.

The fusible conductor has a plurality of conventional electrical bottlenecks, that is to say current bottlenecks in series, the number of which corresponds to the usual configuration for the corresponding rated voltage of the fuse.

According to known NH fuses, the fusible conductors extend preponderantly straight-line axially through the fuse body. In case of high short-circuit currents or virtual melting times of about <10 ms, the structure and the operating mode of such a fuse and of the bottlenecks correspond to those of usual fuses.

The at least one fusible conductor preferably has between the mentioned usual current bottlenecks at least one further special mechanical bottleneck, which can be cut through by at least one actuator and a cutting edge or similar means.

The cutting edge as a dividing element preferably consists of an isolating material or is provided with an isolating coating. This isolating cutting edge leads to an expansion of the isolating gap between the interrupted fusible conductor. The resulting isolating gap is capable of realizing a dielectric strength of at least 2.5 kV, preferably 4-6 kV.

The inventive additional bottleneck according to further embodiments of the invention differs from known usual bottlenecks by the measures outlined below.

The geometric or mechanical additional bottleneck has a residual cross-section, which is greater than that of the usual bottlenecks. The melting integral value ($I^2t$ value) of the bottleneck is dimensioned so as to be equal to or minimally higher than the disconnect integral of the fuse. This configuration causes the bottleneck not to respond upon short-circuit currents.

The area of the additional bottleneck, however, is available for extending the electric arcs.

The geometric bottleneck and the cutting edge are situated in an area without extinguishing medium.

This area is preferably separated on both sides from the areas with extinguishing medium and the electric bottlenecks by thin barriers.

The width of this area is substantially restricted to the edge width and twice the thickness of the fusible conductor.

The fusible conductor(s) are guided through the isolating barrier such that preferably no further sealing to the isolating area is necessary in order to prevent extinguishing medium, for example, quartz sand, from entering.

The isolating barriers may be manufactured from ceramics, vulcanized fiber or else from polymers with or without outgassing (POM). The wall thickness preferably is <1 mm.

The width of the cutting edge preferably is higher than the width of the fusible conductor, however, at least wider than the additional mechanical bottleneck.

The cutting edge has a stroke path going beyond the elongation area of the fusible conductor upon disconnecting. The distance of the shortest connection between a fusible conductor that had been cut to be currentless, is about ≥4 mm. In case of an arc disconnection, the distance is extended due to the combustion of the fusible conductor. Measures for extending the sliding distance may be provided on the cutting edge. The cutting edge may form an isolating gap together with a fixed or deformable counterpart.

In case of active disconnection, the electric arc can extend quite rapidly from the cutting area into the area having the extinguishing medium. The pressure development and thus the housing stress in the cutting area therefore are low. In case of passive function, the high extinguishing capacity is guaranteed by the bottlenecks in the two areas with extinguishing medium, compressed quartz sand, for example.

The material of the additional bottleneck in the cutting area is available for an extension of the electric arc. The material selection of the cutting edge and the isolating barriers or barrier walls allows comparatively good cooling to be realized also in these areas.

The space-saving design and the low influence on the passive fuse behavior allow small sizes to be realized. The routing of the fusible conductor and the impedance do not differ from usual fuses, whereby the voltage drop in the event of pulse currents can be limited. The passive behavior of the additional bottleneck in the event of short-circuit allows the voltage level of the fuse to be limited, and it is possible to comply with the protective level of the arrester.

The possibility of rapidly extending the electric arc with cutting of only one bottleneck in the area having a compressed extinguishing medium or so-called "stone sand" allows the fuse to be driven even at high short-circuit currents, whereby both a passive and an active operating mode is guaranteed.

The above permits the activation of the fuse already in the event of high currents with virtual melting times of <10 ms when only one bottleneck is disconnected This allows the fuse to be interrupted already after a short time in a virtually currentless state at low currents far below the rated amperage and even at high fault currents in the kA range. An almost arbitrary time/current characteristic according to the respective requirements may likewise be realized.

There is the possibility in a design variant having a plurality of fusible conductors, to isolate the fusible conductors simultaneously at a higher effort or one after the other at a lower effort using a single actuator. The direction of movement may be straight or even circular or eccentric in this case. Likewise, the cutting edges may be designed differently according to this mode of movement.

Alternatively, there is the possibility for the fusible conductors to be separately isolated by in each case one cutting edge and one actuator. This also permits an opposite or overlapping movement of the cutting edge, wherein the cutting edges may at the same time serve for the gap formation.

In order to realize quick current interruption, if required, a suitable actuator is realized in addition to rapid fault detection.

For avoiding igniting means or gas generators that rely on explosives, it is proposed according to the invention to utilize a simple igniter, that is to say a so-called bridge igniter, without explosive force of its own. In order to achieve a sufficient force, nevertheless, the pressure wave developing during the ignition is utilized in the manner of a piston/cylinder principle to rupture the mechanical or geometric bottleneck of the fusible conductor(s).

For this purpose, for example, the shaft of the cutting edge itself may be guided within or connected to the piston, or may be attached to a projectile guided within the piston.

The cutting edge may in this respect be arranged very closely to the fusible conductor. However, a distance for increasing the impetus of the cutting edge may also be selected when there is enough space or an external drive. The piston, but the cutting edge, as well, preferably may be guided additionally. The mentioned projectile is contained loosely in the piston. In the piston cavity, the igniter or bridge igniter is located and fills the piston cavity. The cavity is sealed with respect to the projectile over a distance in the direction of movement, which corresponds at least to the path of movement until the disconnection of the fusible conductor(s). This guarantees that the sealing with respect to the projectile within the piston is not removed until after the bottleneck is ruptured.

As usual in passive fuses, the fusible conductors of the fuse preferably are attached rigidly to the fuse housing by a lower cap or an end cap. The double-sided isolation of the cutting area from the area of the extinguishing mean serves as an additional guide of the fusible conductors in the narrow cutting area.

The guide in the passages of the isolation plates is in this case designed such that the fusible conductor(s) in case of transverse position to the cutting edge are allowed to slightly deform in the direction of the movement of the cutting edge upon impingement of the cutting edge. It has shown that this slight deformation requires less effort than a rigid guide of the fusible conductor. When the fusible conductors are ruptured, they are bent on both sides between the isolation and the cutting edge. Alternatively, a punch-out is also possible in case of a corresponding design of the cutting edges and necessary force actions.

The force action of the actuator is substantially base on the thermal expansion of the gas surrounding the bridge igniter. After the piston has been opened, this minimally heated gas amount may easily relax within a very small volume, namely, if necessary, directly in the cutting area, so that no reinforcement of the fuse housing, the caps or a ventilation or similar needs to be provided.

If longer disconnection times are sufficient in the protection concept for the employed surge protection device or the connected loads, then actuators having slower response times may also be used. For example, shape memory alloys or other volume changing materials are conceivable here. The highest requirements regarding the coordination between the force needed to cut through or rupture a bottleneck are linked to the required pulse current carrying capacity at which no disconnection of the fusible conductor of the fuse is intended to be caused.

As compared to lightning surge arresters on the basis of spark gaps, the loads are lower in arresters on a varistor basis. In general, lightning arresters are assumed to have a maximum load of 100 kA 10/350 μs. In usual alternating current networks, this means a load of 25 kA 10/350 μs for the individual spark gap. The fusible conductor of a fuse should satisfy the above requirement in the described application. This relates both to the usual electrical bottlenecks and the described additional mechanical or geometric bottleneck.

In a usual NH fuse, this requirement approximately corresponds to a fuse having a fuse current rating of 315 A. As to the rated voltage of the fuse, a voltage in the range of the line-to-line voltage of the network, where the arresters are employed, is often selected. Thus, the fuse should be suitable for a voltage of 400 volts in a usual 230/400 volts network. In case of disconnection, the backup fuse of the arrester does not generate an arc voltage which is above the protective level of the arrester. In the design of bottlenecks of NH fuses, a voltage of about 300 volts may be expected per bottleneck. From these requirements results a number of a minimum of three and a maximum of five usual known bottlenecks for such a fuse, wherein a usual protective level of about 1.5 kV is not exceeded in general.

A further variant of the solution according to the invention is based on a controllable fuse, in particular for the application as an arrester backup fuse, wherein, in this variant, a defined rupturing of a fusible conductor of a fuse is performed while utilizing a special additional bottleneck.

Hence, this approach aims at a space-saving and cost-effective embodiment of a triggerable fuse which is based on the defined rupturing of a special additional bottleneck of a fusible conductor of a fuse in the extinguishing medium after activation of a trigger. The remaining properties of an otherwise passively fully operable fuse are not affected. The particularities of this approach are the simplicity of the trigger and the coordination of the additional geometric bottleneck to the classical known fuse bottlenecks.

When tensile forces are exerted on one or more fusible conductors, all of the present bottlenecks, that is to say the entire fusible conductor strip and the attachment of the strip will be elongated. The elongation length in fusible conductors, in particular fusible copper conductors, of a length of 5-8 cm may easily be a few millimeters until rupturing.

If an isolating distance of about 3 mm is intended to be created, the necessary stroke path may already be significantly above 10 mm, which results in an undesired increase in size of such a component.

In order to delimit the elongation, there is the possibility of fixing the fusible conductor partially relative to the housing or extinguishing medium (sand). Alternatively, there is the possibility of partially solidifying the extinguishing medium.

In contrast to the measures described above, in accordance with the inventive teaching, the elongation at the fusible conductor takes place predominantly at an additional mechanical, that is to say geometric predetermined breaking point.

The entire elongation is therefore only a little above the necessary elongation at break of the predetermined breaking bottleneck and the pursued isolating distance.

The additional mechanical breaking point, also referred to as a tensile bottleneck, has to be coordinated and dimensioned in conjunction with the known electrical bottlenecks.

In order for mechanical bottleneck to have a significantly lower tensile strength, the cross-section thereof is smaller than that of the electrically relevant bottlenecks. Thus, it must be secured, however, that despite the smaller cross-section at identical current load, the mechanical bottleneck will not respond before the electrical bottlenecks at all current loads, even transient loads, but will respond n a time-delayed manner or at higher loads.

The related embodiment of the invention thus is based on one or more parallel fusible conductors of the fuse in an extinguishing medium. The fusible conductors have a plurality of conventional bottlenecks in series, the number of which corresponds to a usual configuration for the corresponding rated voltage of the fuse.

According to usual NH fuses, the fusible conductors mainly extend axially through the fuse body in a straight line. The fusible conductor(s) preferably have between the mentioned known bottlenecks at least one further, special bottleneck, which may be ruptured by an actuator.

The employed actuator furthermore causes a defined expansion of the interrupted fusible conductor. The developing entire isolating distance realizes a dielectric strength of at least 2.5 kV.

The additional bottleneck differs from the usual bottlenecks by the features below.

The additional mechanical or geometric bottlenecks has a residual cross-section which is significantly smaller than that of the usual bottlenecks. The melting integral value of the bottleneck in the period of transient pulse current loads, in particular of the current pulse shape 8/20 μs and 10/350 μs, is identical or even greater than that of the usual known bottlenecks.

Furthermore, the mechanical strength relative to the force direction of the actuator is significantly lower than the mechanical strength of the other known bottlenecks.

In this respect, the force of the actuator acts almost only upon the inventive additional bottleneck. The elongation of the usual known bottlenecks due to the force action of the actuator is negligible.

Compared to the electrical bottlenecks, the mechanical bottleneck is designed such that it will in general not respond as well at mains frequency loads. The area of the bottleneck, however, is available for the extension of the electric arcs from the normal bottlenecks.

As to its dimensions, the mechanical bottleneck thus is of a significantly smaller design than the usual bottlenecks. In strip-shaped fusible conductors, the bottleneck is designed such that a non-uniform current distribution can be largely prevented even at steep current rises. For this purpose, the bottleneck is ideally designed as a tapering on both sides of the strip over the entire width with a length of <500 μm, optimally of <100 μm. In such a design with usual punch-outs or continuous recesses, these are realized so that the recesses are of similar shortness, and the width of the recesses does not exceed twice the length.

Principally, further design variants are also possible. The target of the proposed measures is a current density distribution in the fusible conductor and the bottlenecks that is as uniform as possible even at a pulse current load with very good and almost delay-free heat dissipation from the area of the geometric bottleneck.

Even at rapid current pulse loads of up to <1 ms, the aforementioned ensures a lower temperature increase within the mechanical bottleneck having a smaller cross-section than in the usual electrical bottlenecks having a greater cross-section.

Figure 2:
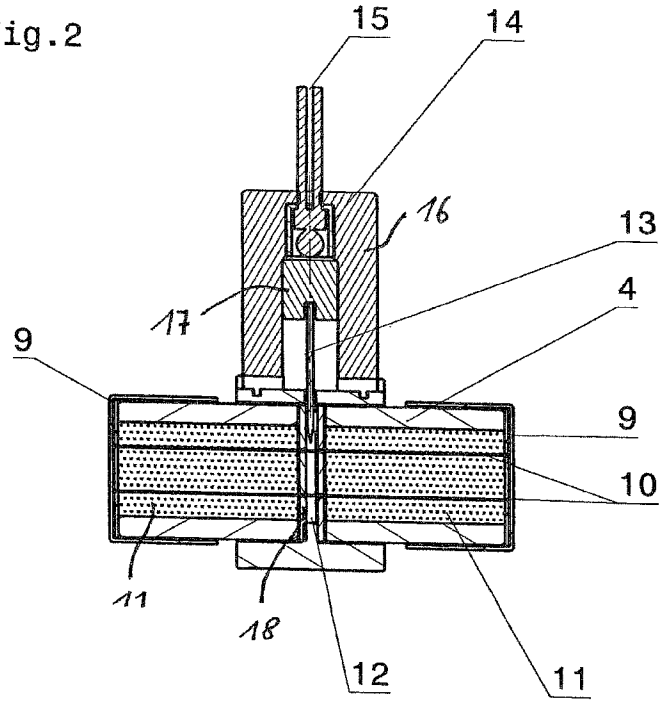
Figure 3:
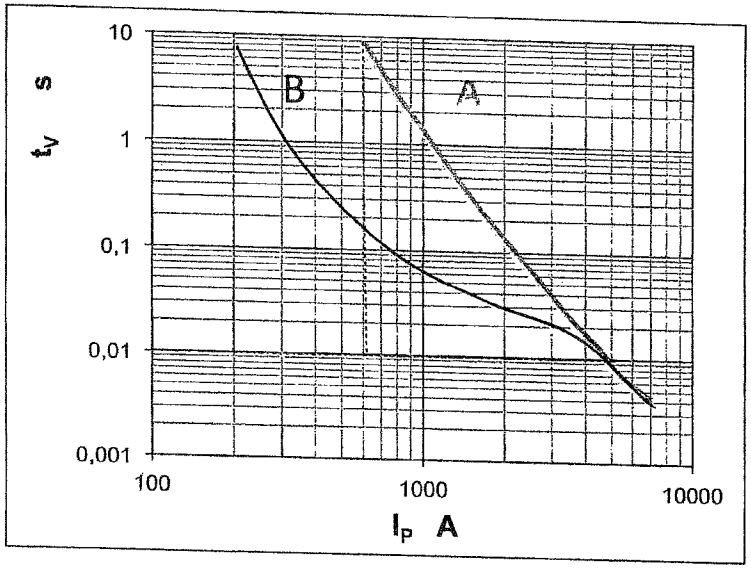
Figure 4:
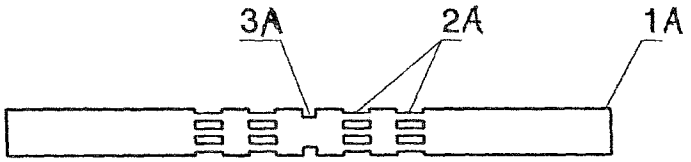
Figure 5:
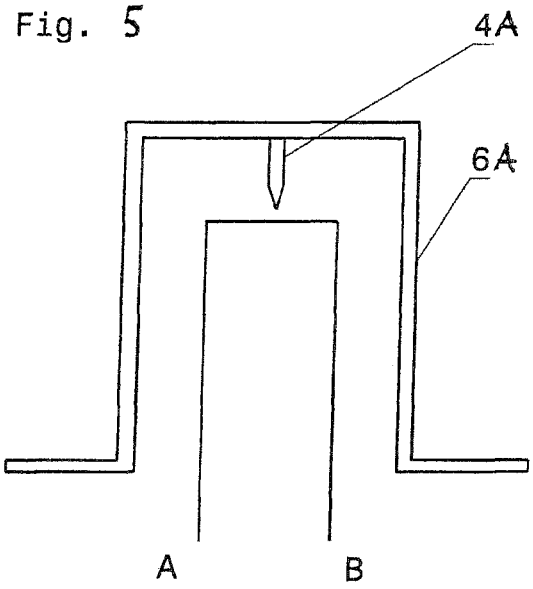
Figure 6:
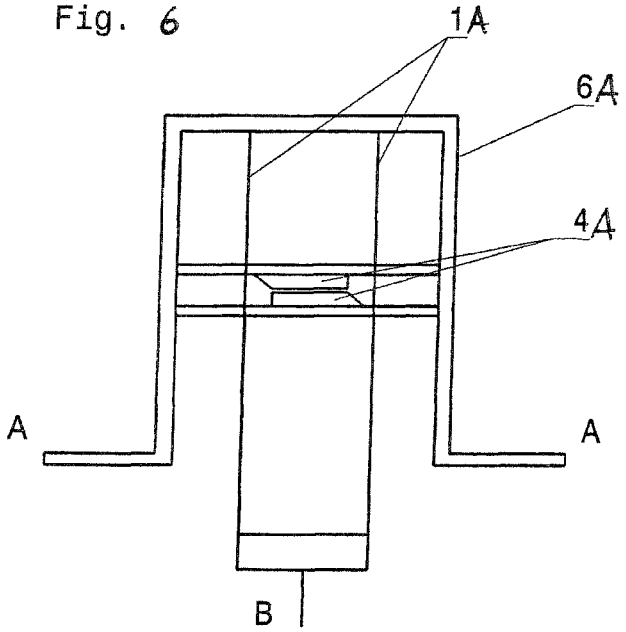
Figure 7:
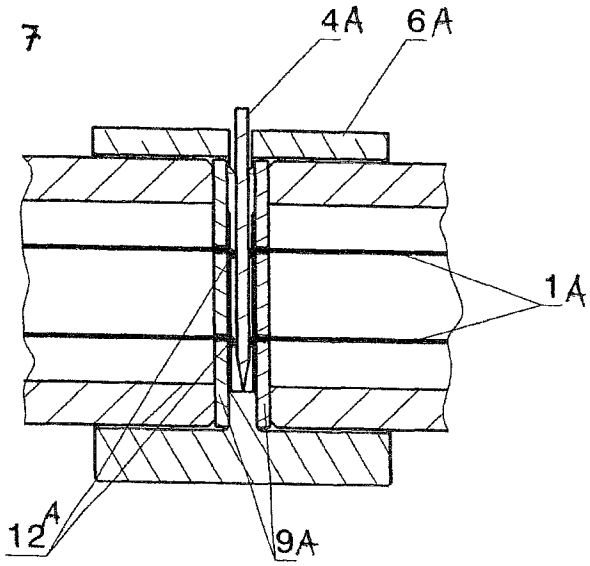
Figure 8A:
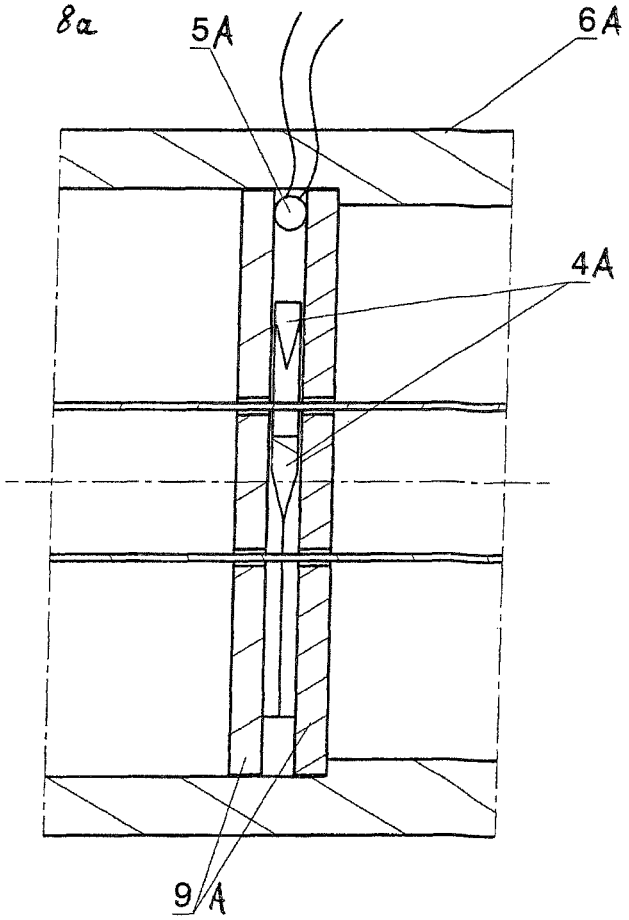
Figure 8B:
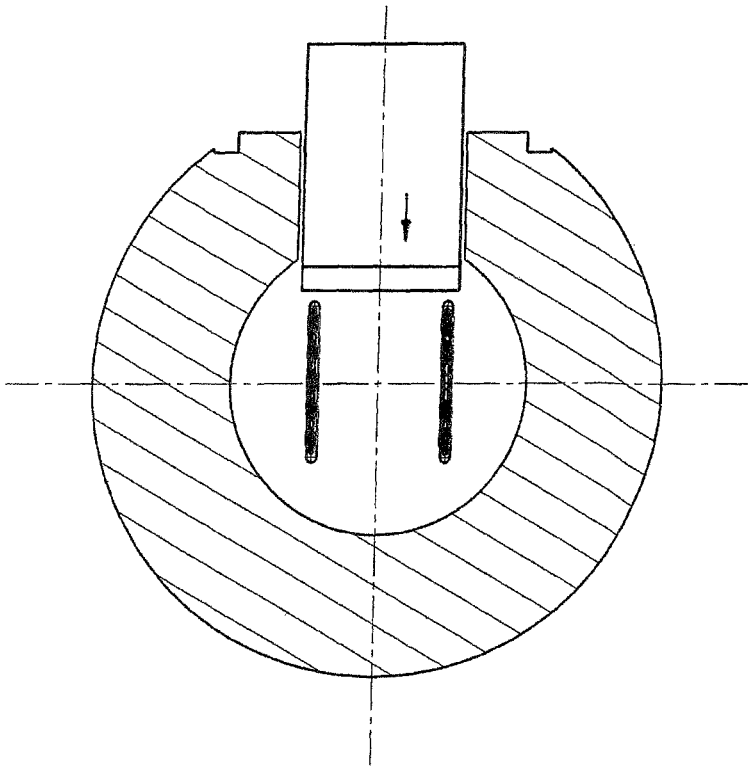
Figure 9:
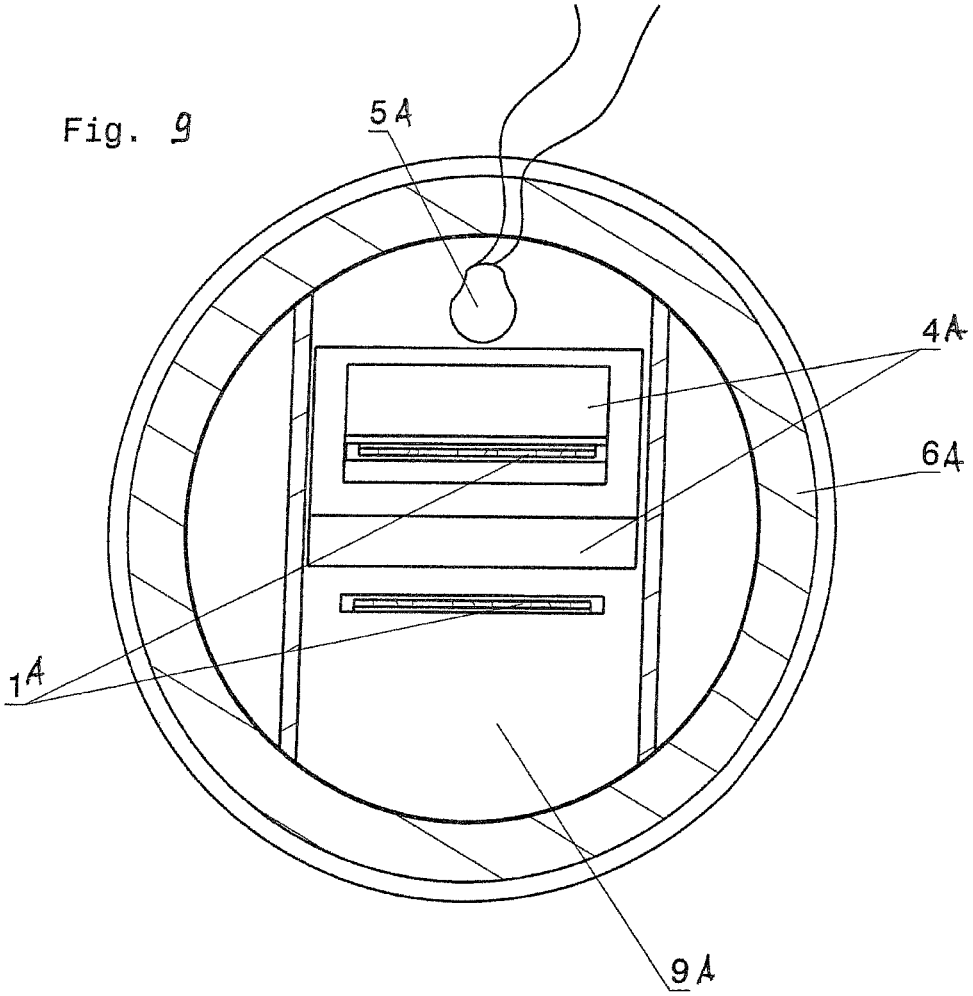
Figure 10:
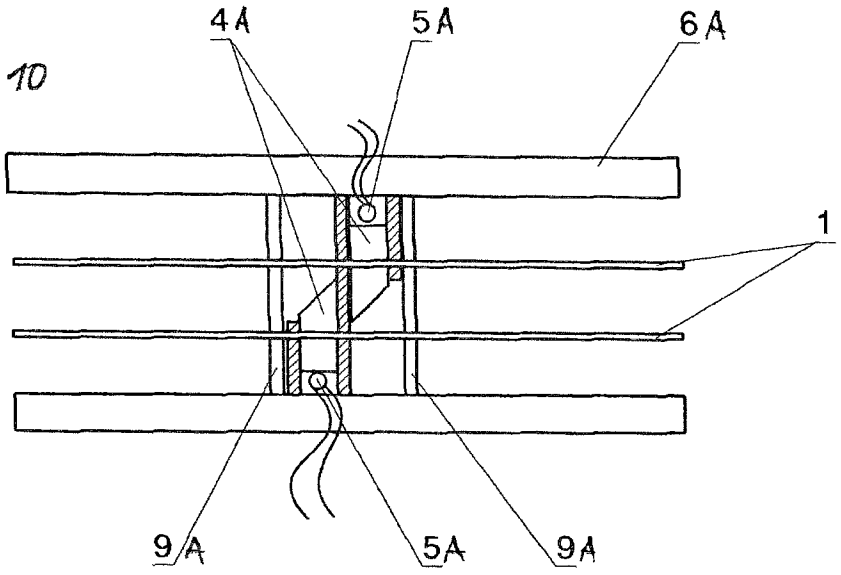
Figure 11:
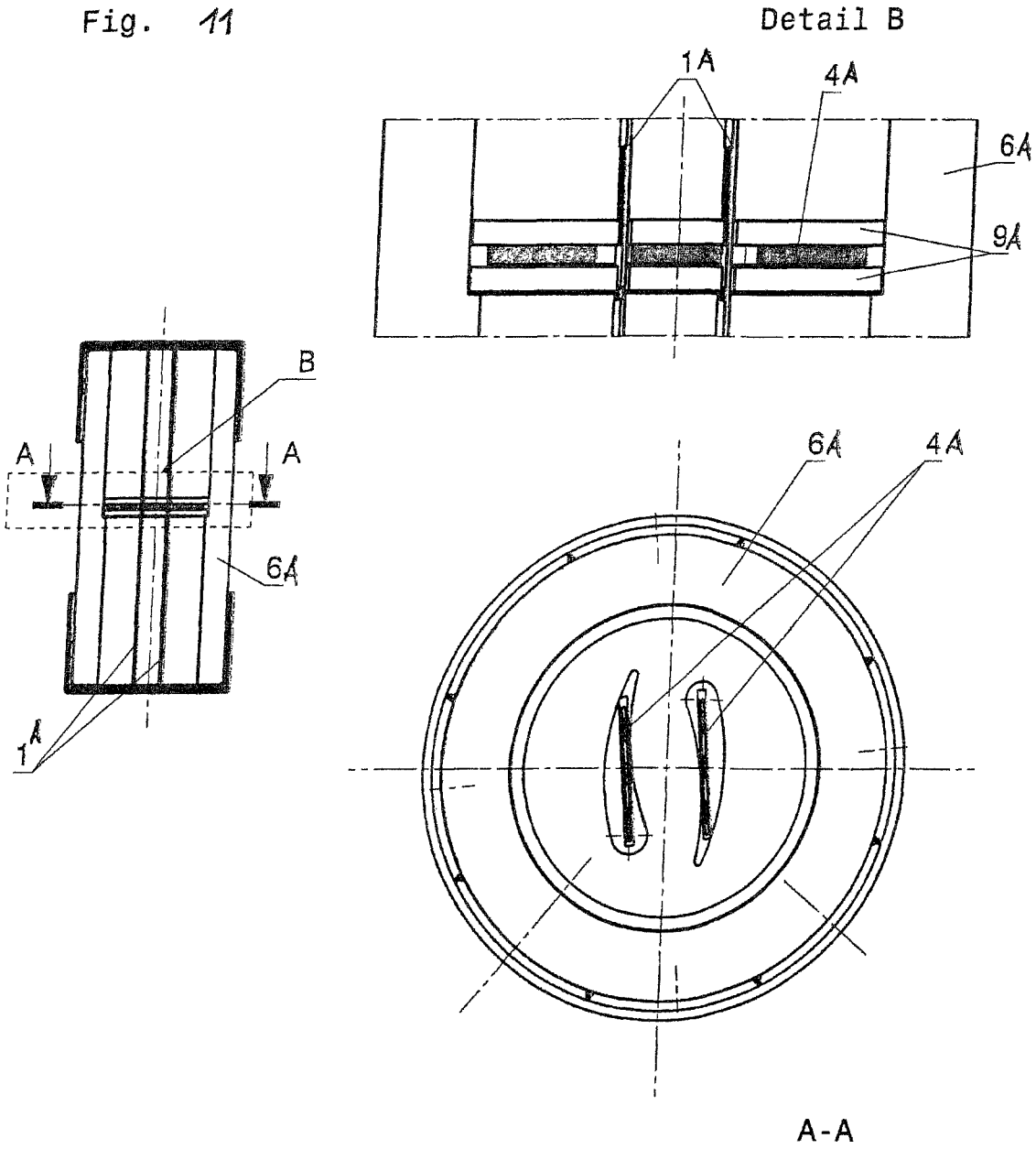
Figure 12:
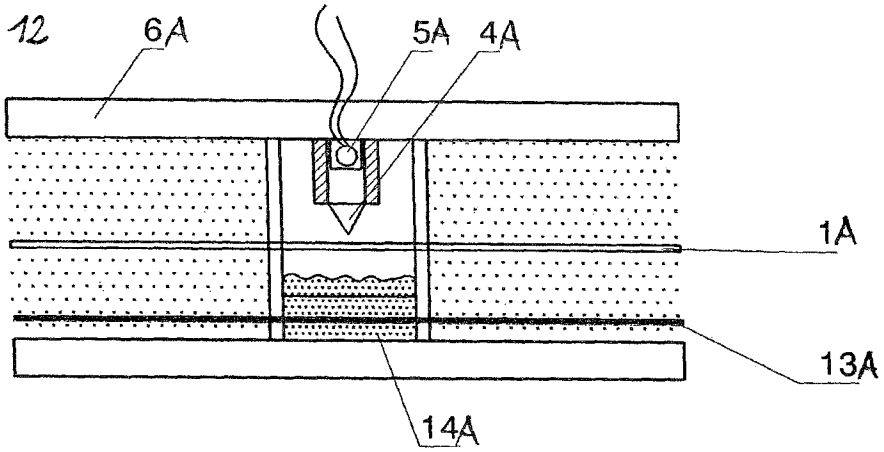
Figure 13:
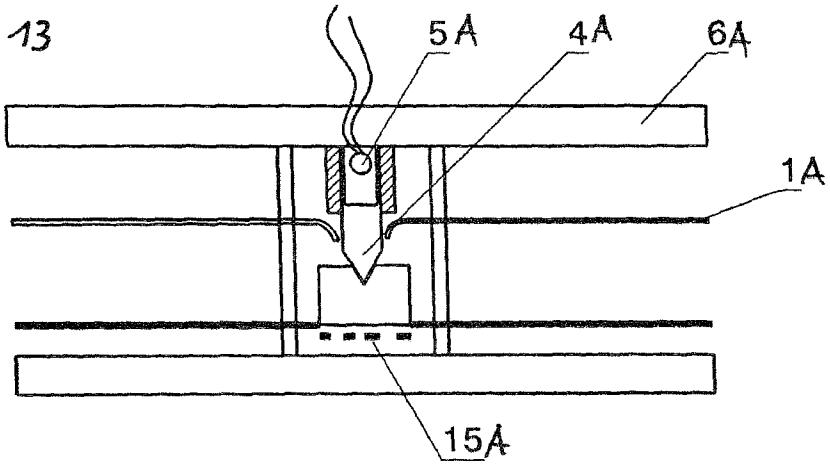
Figure 14:
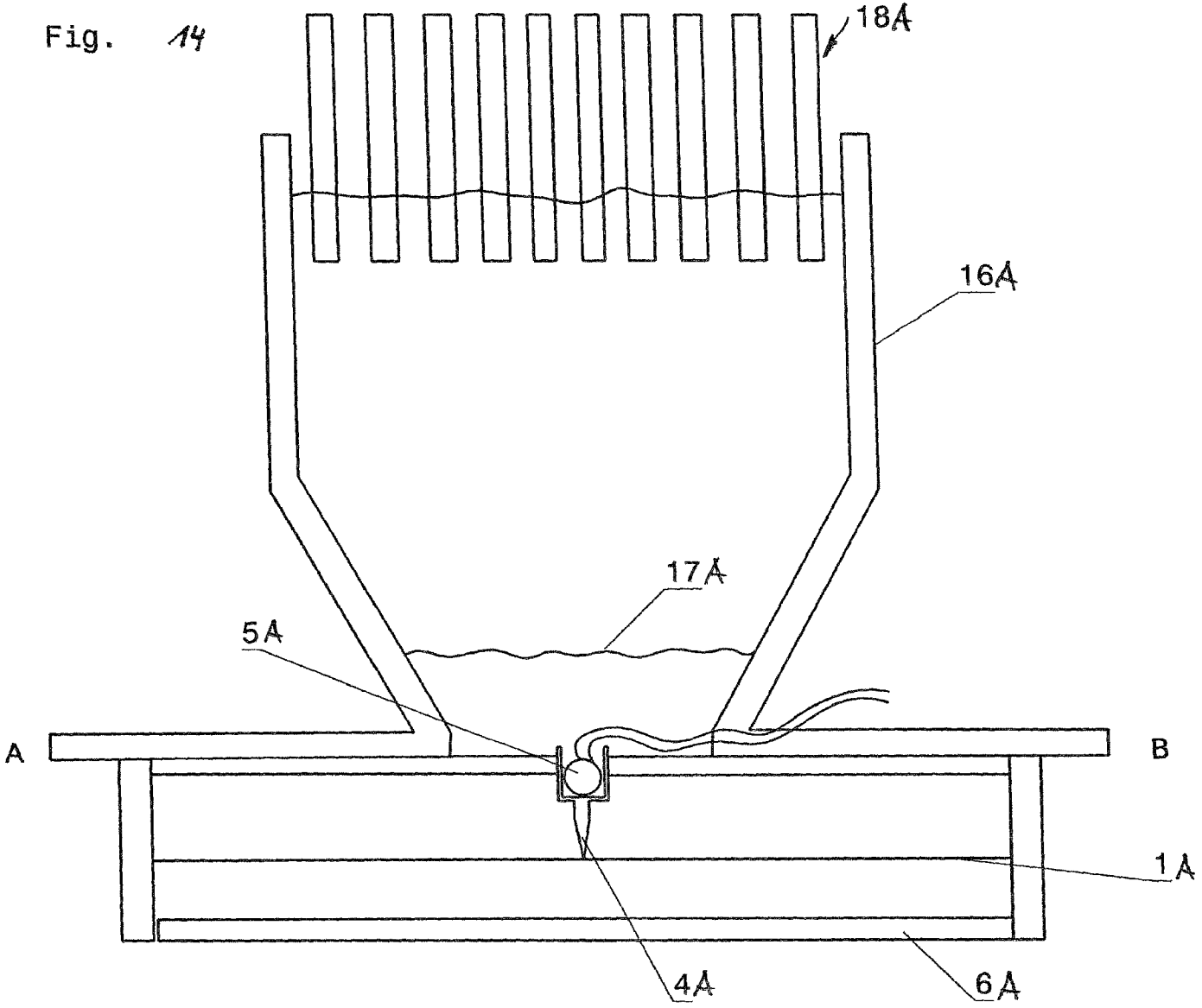
Figure 15:
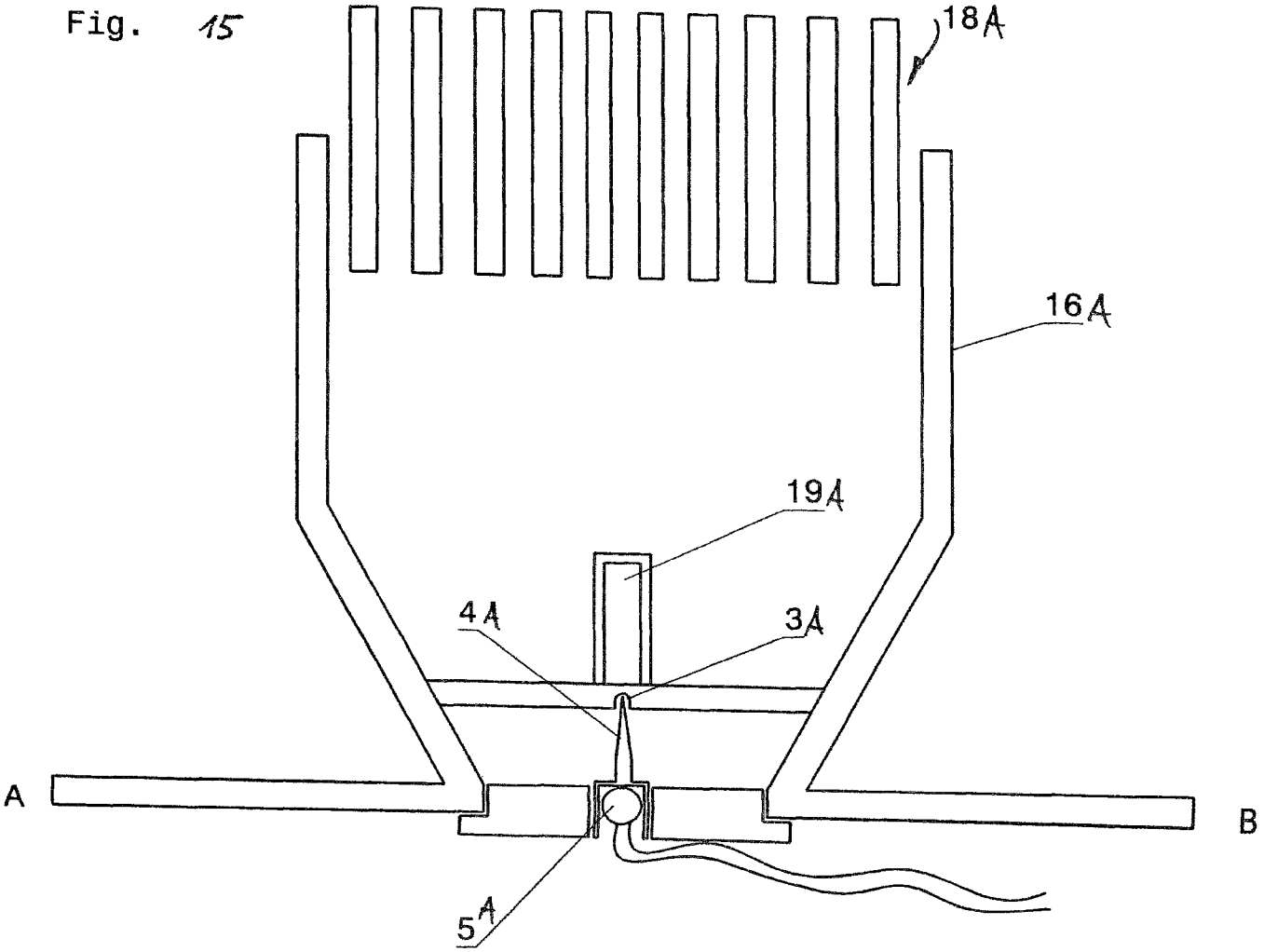
Figure 16:
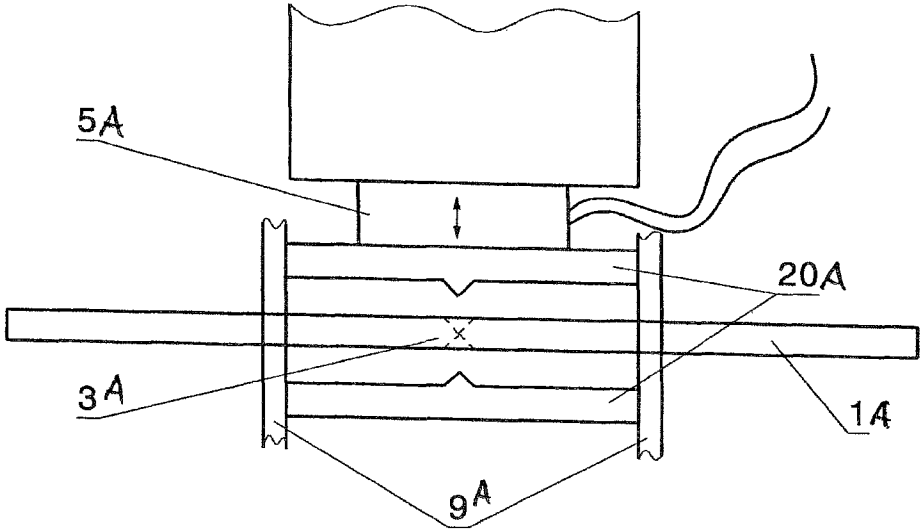
Figure 17:
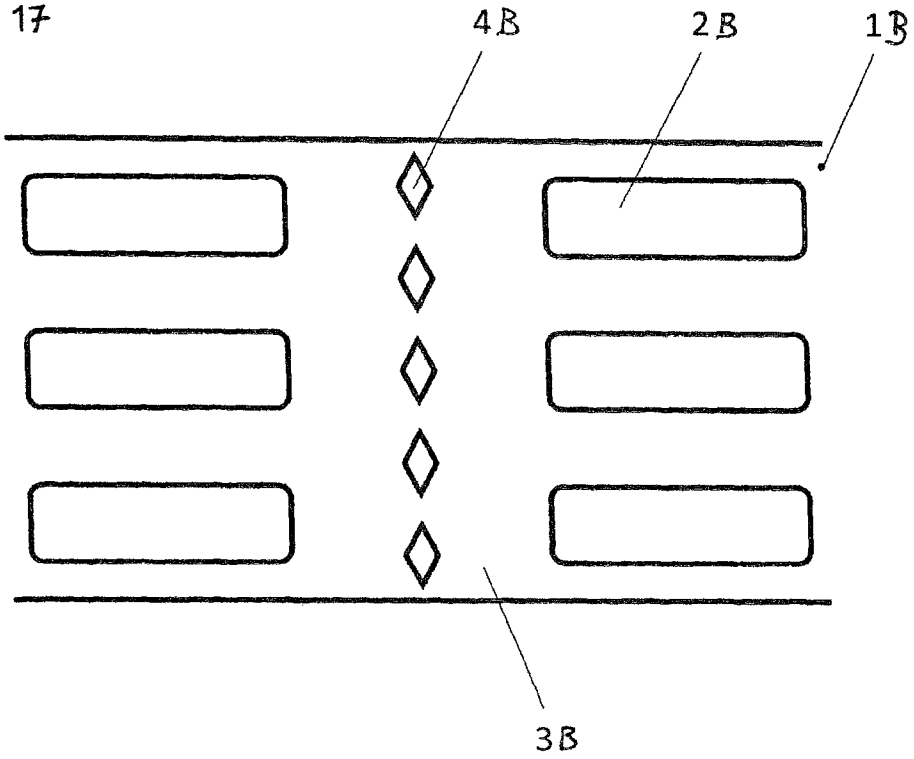
Figure 18:
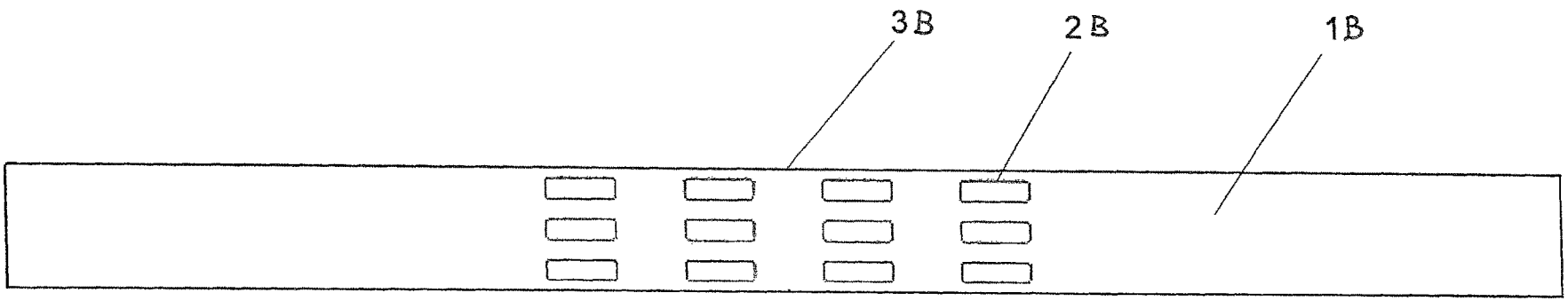
Figure 19:
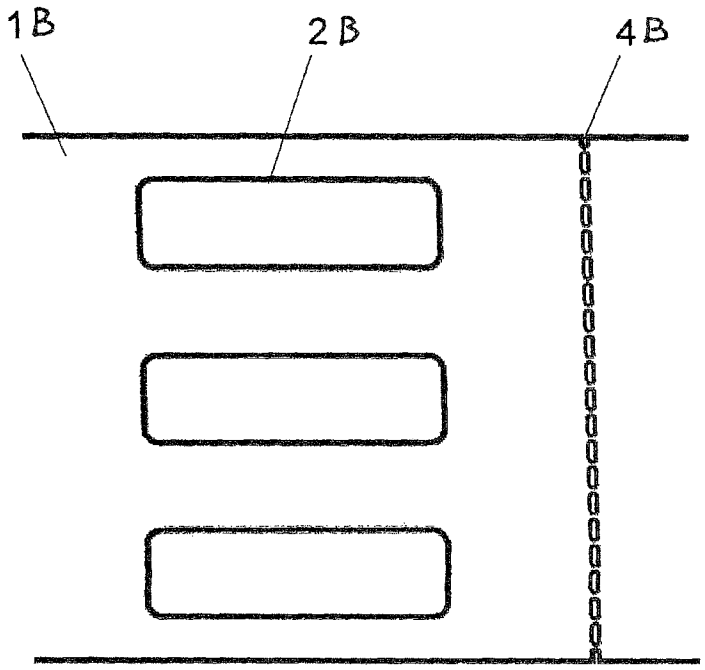
Figure 20A:
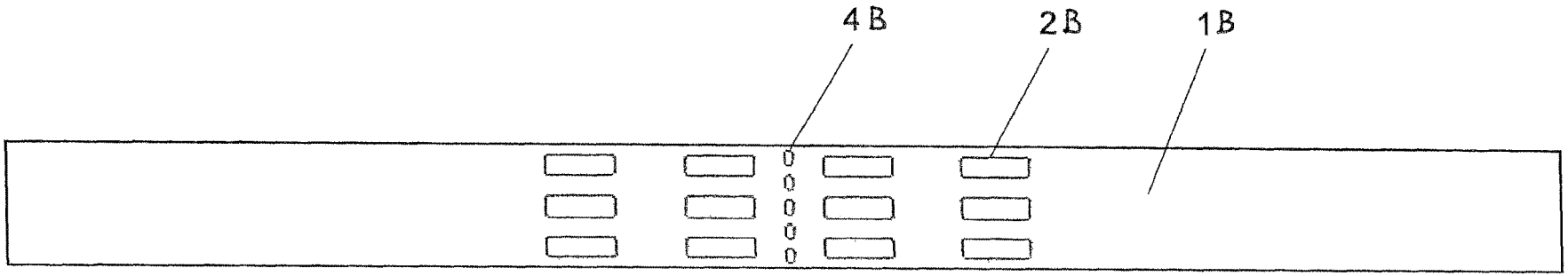
Figure 20B:
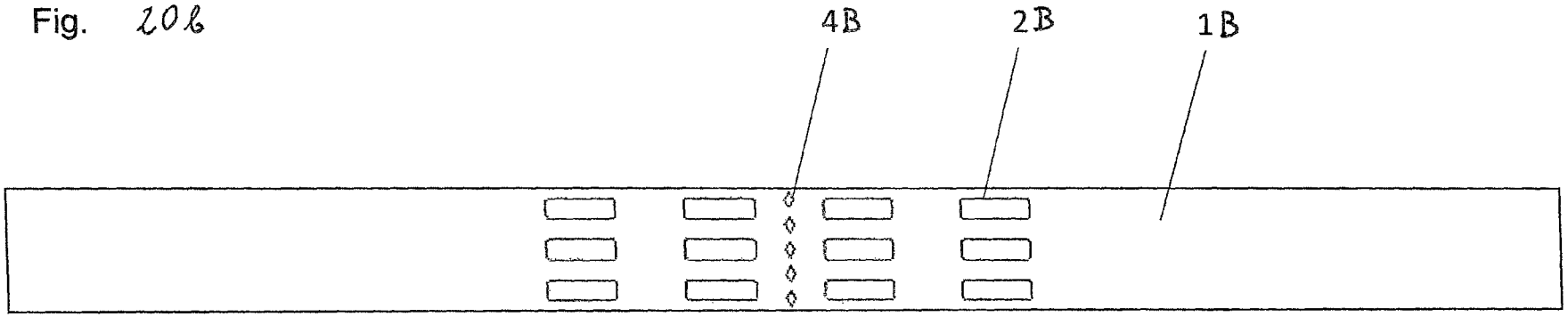
Figure 20C:
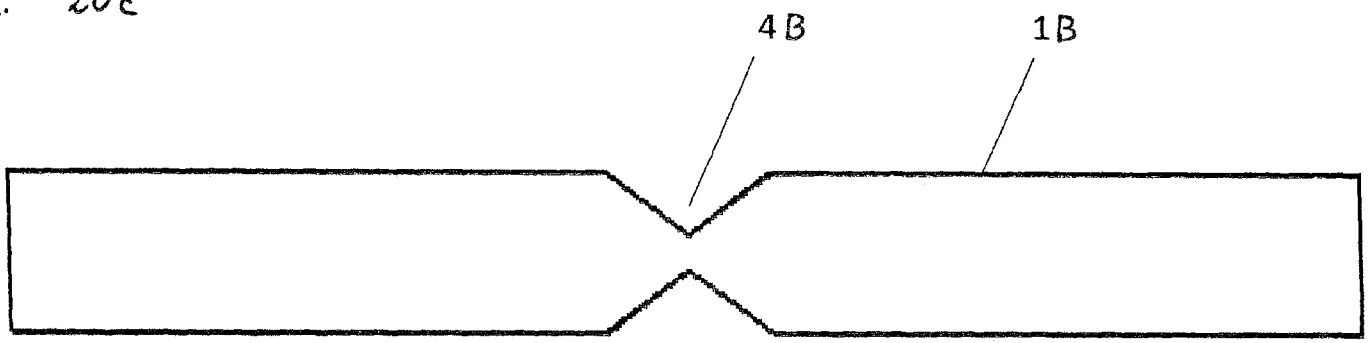
Figure 21A:
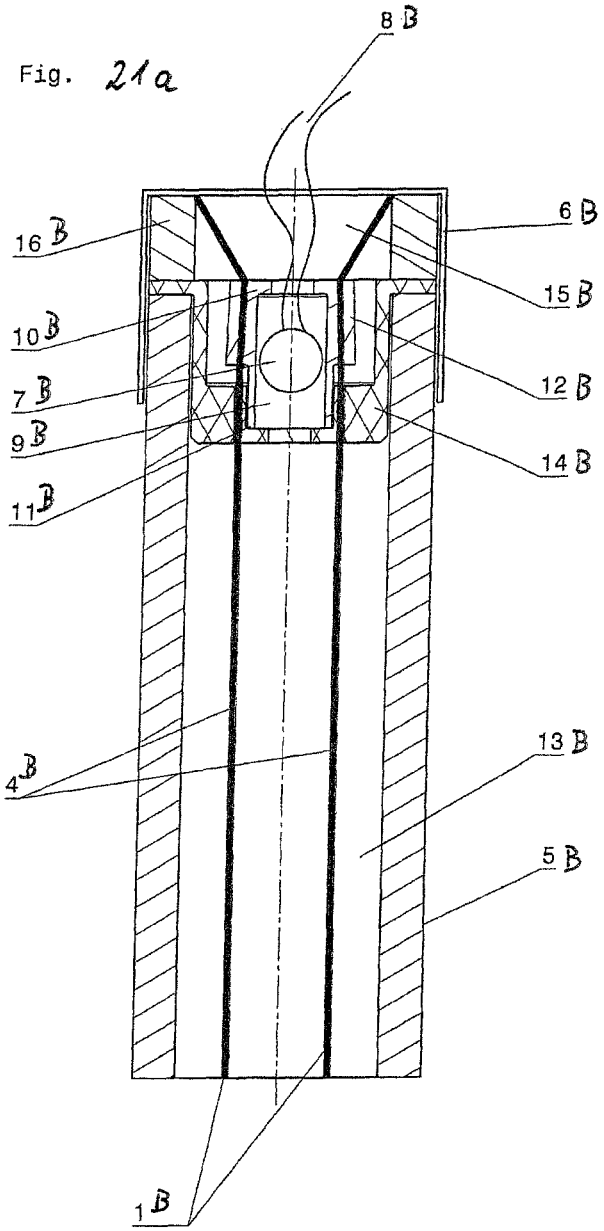
Figure 21B:
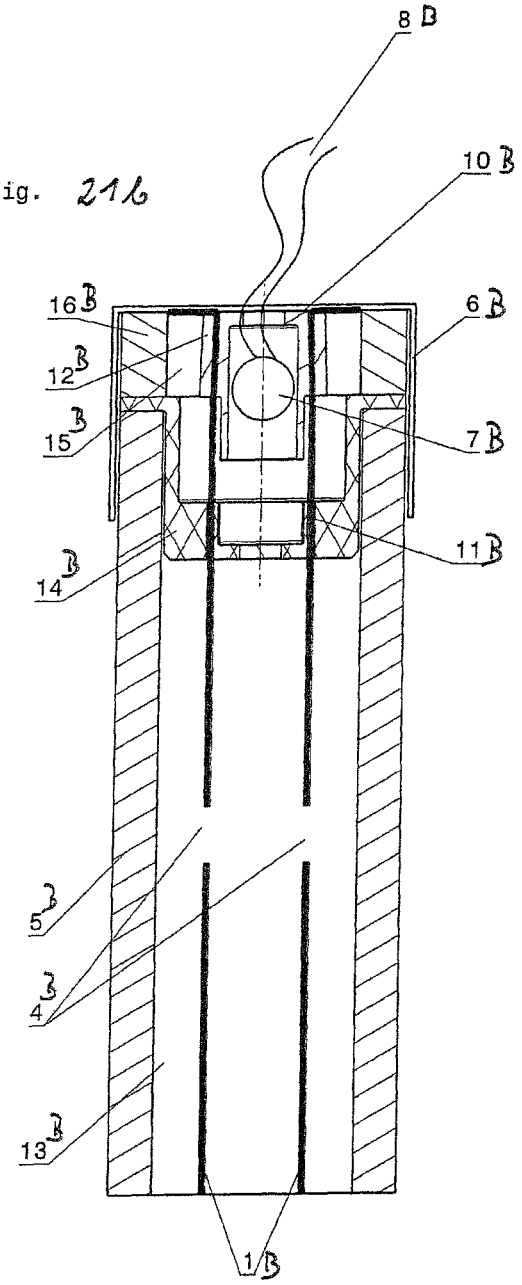
Figure 22A:
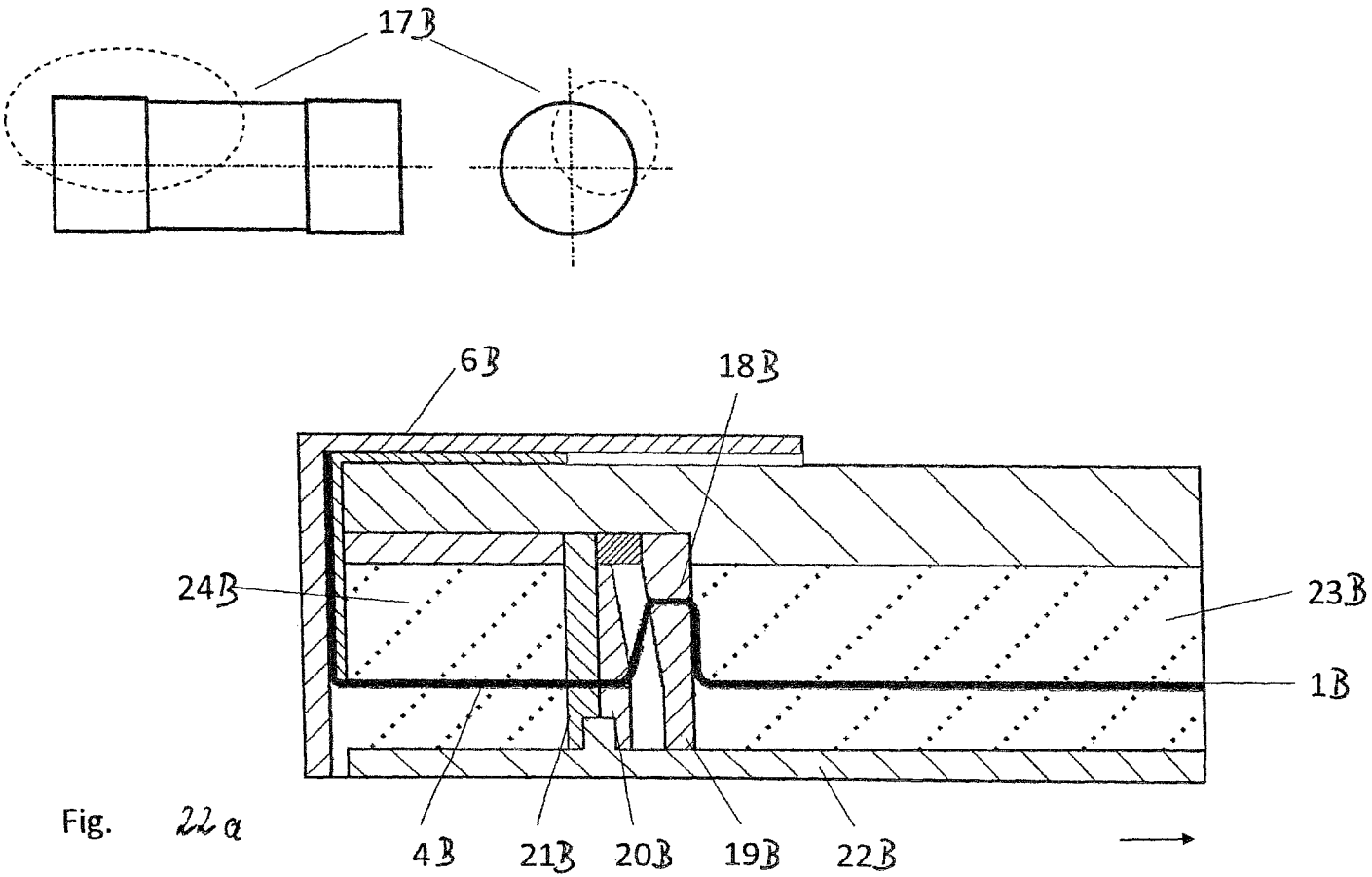
Figure 22B:
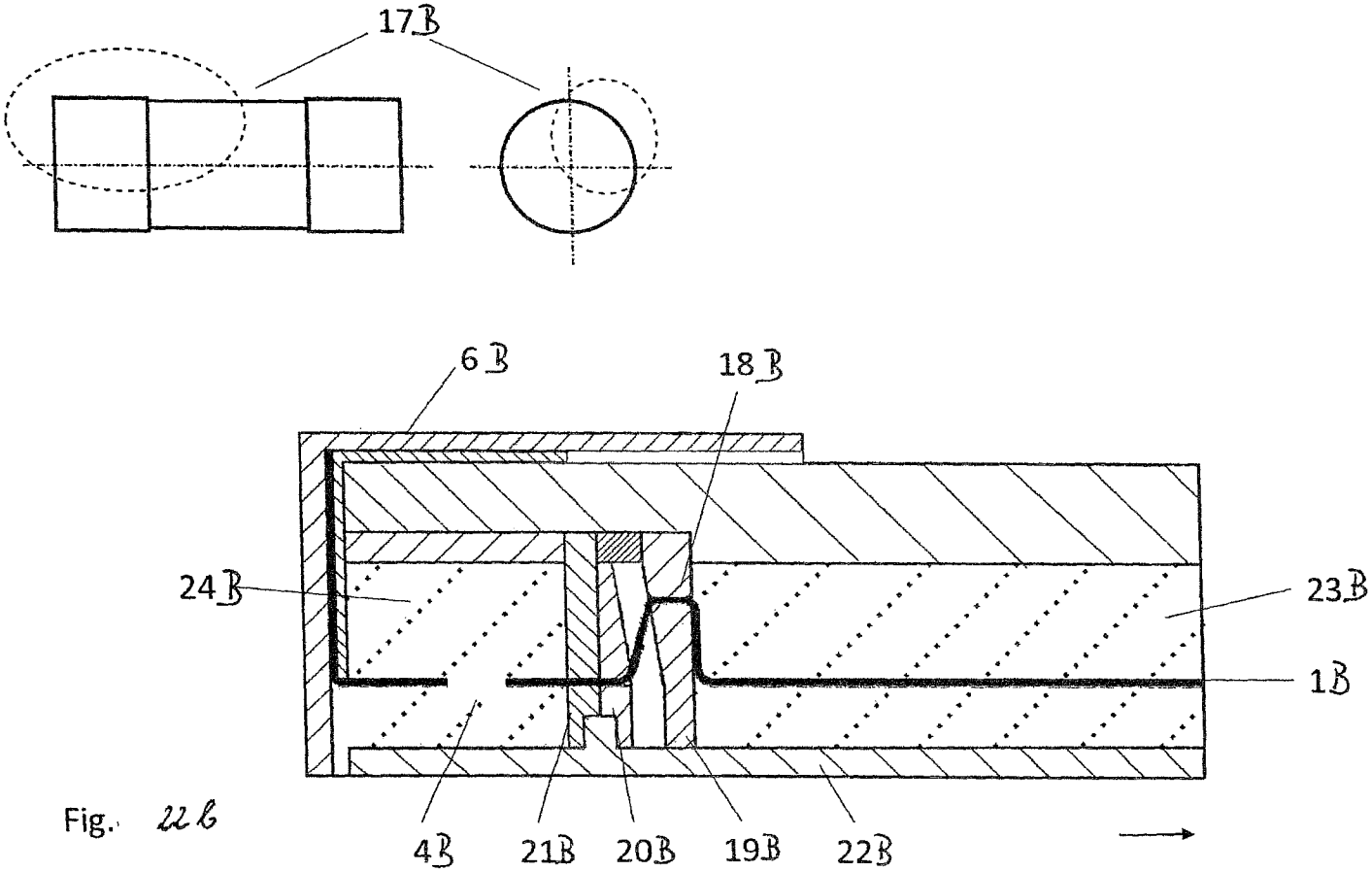
Figure 23:
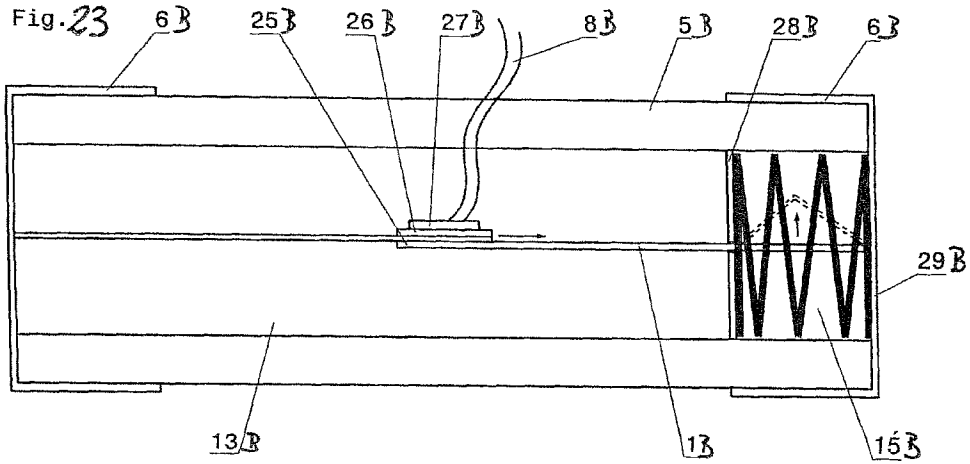

Hereinafter, the invention will be explained in more detail on the basis of exemplary embodiments with reference to figures. Shown are in:

FIG. 1 a block diagram of a basic arrangement comprised of a detection and evaluation unit, a control, an energy supply and a triggerable fuse;

FIG. 2 an exemplary structure of a triggerable fuse in a sectional view;

FIG. 3 an exemplary time/current characteristic of a triggerable fuse according to the invention;

FIG. 4 an exemplary fusible conductor for a capsule fuse with bottlenecks, which are designed longer than known usual bottlenecks for achieving short melting times at small overcurrents;

FIG. 5 a construction having a non-linear fusible conductor, but having an angular routing of the fusible conductor, with the connections A and B;

FIG. 6 a fundamental arrangement having two fusible conductors and cutting edges working in opposite directions, each with an actuator;

FIG. 7 a partial area of the arrangement according to FIG. 2 after a disconnection without arc action;

FIG. 8*a* an arrangement, in which the fusible conductors are cut simultaneously and transversely;

FIG. 8*b* a representation of the simultaneous cutting of the fusible conductors at a vertical orientation toward the fusible conductor;

FIG. 9 a cutting element having two offset cutting edges in cross-section, which enables the cutting of two fusible conductors transversely at a short stroke path;

FIG. 10 in each case a cutting edge and an actuator for cutting a fusible conductor at short stroke paths and an opposing movement of the cutting edges;

FIG. 11 a cutting element having two cutting edges and rotatory movement, which can be forced by a corresponding guide and only one actuator;

FIG. 12 a further embodiment, in which a further fusible conductor of a fuse, which may be configured in a wire form, for example, will not be interrupted by the disconnection device;

FIG. 13 an alternative to a wire with a fusible conductor on a carrier;

FIG. 14 a cutting arrangement in parallel to a horn spark gap short-circuited by a fuse wire of a low fuse current rating, and wherein, when the main fusible conductor is ruptured, the current will commutate to the fuse wire, which will ignite the horn spark gap, which horn spark gap then extinguishing the current in an arcing chamber;

FIG. 15 a further development of a cutting and separating edge;

FIG. 16 an arrangement having an actuator with a short, yet variable stroke path;

FIG. 17 a fusible conductor with known bottlenecks in the form of oblong recesses, with an area of unreduced cross-section being provided between the known bottlenecks, and an additional bottleneck in the form of a plurality of rhombus-shaped recesses of short total length being realized within this area;

FIG. 18 a fusible conductor for a capsule fuse having bottlenecks, which, for achieving short melting times at small overcurrents, are designed different from usual known bottlenecks;

FIG. 19 an embodiment, in which the additional mechanical bottleneck 4 according to the invention is introduced between usual known bottlenecks;

FIGS. 20*a*-20*c* various design variants of the additional mechanical bottleneck according to the invention;

FIGS. 21*a* and 21*b* an exemplary structure of an NH fuse in a capsule design (in sections) with A in the normal state and B in a triggered state;

FIGS. 22*a* and 22*b* an embodiment for use of shape memory alloys with special utilization of the tensile force;

FIG. 23 an embodiment in which the tensile force acts at a solder joint, which can be disengaged, for example, by a reaction foil of exothermal reaction in the shortest time possible, this means in the millisecond range.

FIG. 1 shows a basic arrangement of an embodiment according to the invention comprised of a detection and evaluation unit 1, a control 2, an energy supply 3 and a triggerable, controllable fuse 4.

The control unit 2 exhibits an additional external control input 5.

The detection and evaluation unit 1 has a plurality of measuring inputs 8, and an input for current measurement 6 as well as voltage measurement 7.

Further sensors can be connected to the inputs 8.

Furthermore, there is the option of providing a communication input for external measurement devices.

The signal emission to the fuse 4 may be performed in a wired manner, but also in a wireless manner when the ignition device (bridge igniter) is separately supplied.

FIG. 2 shows an exemplary structure of a triggerable fuse having a cutting element 13 in a sectional view.

As far as the fuse is concerned, this representation corresponds to the classical structure of known NH fuses with an extinguishing medium in the form of quartz sand, and a complementary area for activating a bridge igniter 14.

The fuse 4 according to the invention exhibits two connection caps 9, two fusible conductors 10, two areas 11 with an extinguishing medium, for example, quartz sand, and an extinguishing medium-free region 12. A cutting edge 13 may be introduced into the extinguishing medium-free region 12 for separating the fusible conductors 10.

When the bridge igniter 14 is activated, the cutting edge 13 is accelerated in the direction of the fusible conductors 10 and cuts them in two.

In the movement path of the cutting edge 13, a stopping area may be provided in the extinguishing medium-free region. This stopping area serves for damping the impact and thus for protecting the housing wall and the cutting edge. In addition, this area may be utilized for a gap-like arc pinch-off. The stopping area may be realized, for example, from a soft or elastic or porous plastic material with or without gas emission. Alternatively, a damping in a tapering gap-like area of isolating material is also possible.

The activation of the bridge igniter 14 is performed in this case via control lines 15, which can be connected directly to the control 2 (see FIG. 1).

The bridge igniter 14 is situated in an enclosure 16, wherein the enclosure 16 exhibits a piston 17 driven by the bridge igniter 14, which piston is in communication with a separating element 13.

The extinguishing medium-free region 12 is formed as a channel that is isolated from the extinguishing medium 11. The channel exhibits side walls 18, which may also serve for guiding the separating element 13.

FIG. 3 shows the time/current characteristic of an arrangement according to the invention by way of example.

For reasons of clarity, the characteristics are illustrated in a simplified manner only in the time range from about 4 ms to about 10 ms. Additionally, the fundamental progress in the time range up to about 4 ms has been illustrated.

The adiabatic heating of fusible conductors of gG fuses may be up to >5 ms, depending on the design of the fusible conductor. The passive fusible conductor of fuse A, for example, has a fuse current rating of about 315 A. Fuse B has a significantly lower fuse current rating of 100 A, however, at an almost identical adiabatic melting integral ($I^2t$ value).

Due to this value, the pulse current carrying capacity, which is important, for example, for the application in combination with a surge protection device, is comparable for both fuses. In order to achieve such a characteristic, the fusible conductor B needs to be designed correspondingly or retained additionally.

In the adiabatic time range, the behavior of the proposed protection device is determined by the passive melting behavior of the fusible conductor of the fuse.

In case of smaller currents and theoretically longer passive melting times of the respective fuse A or B, the time until the active interruption of the fusible conductor, for example, of 10 ms, may be arbitrarily delimited until the passive melting time. The time/current characteristic may thus be arbitrarily designed to be below the time/current characteristic of the fuses. The setting of maximum current flow durations and maximum current flow levels is thus also possible in a wide range. The exemplary range having a variable characteristic is delimited by the dashed lines below the passive characteristics of the fusible conductors A and B. Hereby, a good adaptation to various protective tasks is possible.

FIG. 4 shows a fusible conductor 1A for a capsule fuse having bottlenecks 2A, which are designed to be longer than known electrical bottlenecks for achieving short melting times at small overcurrents. This results in an advantageous decrease of the fuse current rating of the fuse. The length of the bottlenecks approximately corresponds to the distance of the non-modified cross-section of the fusible conductor 1A between the bottlenecks. Between the bottlenecks, an additional bottleneck 3A for cutting the fusible conductor is located and has a lower modulation degree than the bottlenecks 2A.

In order to achieve optimum extinguishing properties with a simple quartz sand filling as extinguishing medium, splitting the fusible conductor into a plurality of fusible conductors is advantageous with high pulse currents to be overcome and the high metal content associated therewith. Two fusible conductors of identical design are advantageous for the relevant requirements according to the invention.

Basically, the constructional size, the geometry of the fuse housing, the number of fusible conductors, etc., may be varied arbitrarily. Apart from a straight routing of the fusible conductors and a connection on both sides to opposite front sides, the connections A and B may, of course, be also on one side of the housing 6A according to FIG. 5.

Apart from housings made of isolating material, electrically conducting housings may also be realized having one or two isolated entries for the fusible conductor(s).

The design of the fusible conductor may use strips, wires, tubes or the like.

The routing of the fusible conductors and the positioning of the connections are to be designed such that, at a load with transient pulses, the forces, the current intensities, and in particular the protective level of the entire arrangement, as well, will be observed. The inductive voltage drop at the fuse arrangement needs to be restricted to values of <300 V, if possible, <200 V, at loads of more than 25 kA. For reducing inductivity, there is the option of designing the routing of the fusible conductors even to be bifilar.

FIG. 6 shows a fundamental arrangement of two fusible conductors 1A with two cutting edges 4A working in opposite directions, each with an actuator (not shown for simplification purposes).

In this case, the housing serves at the same time as a connection A. The further connection B is led out from the housing 6A in an isolated manner. The coaxial arrangement reduces the inductive voltage drop.

FIG. 7 illustrates a partial area of the arrangement according to FIG. 2 after a disconnection without an arc action.

In FIG. 7, the lateral movement of the fusible conductor areas 12A between the cutting edge 4A and isolation plates can be recognized. Due to the close routing of these parts, clamping of the parts may be utilized in a corresponding design for decelerating the cutting edge 4A and for forming a gap.

FIG. 8*a* shows an arrangement, in which the fusible conductors are cut simultaneously and transversely. FIG. 8*b* shows a simultaneous cutting of the fusible conductors at a vertical orientation toward the fusible conductor. According to FIG. 8*a*, the actuator 5*a* and the cutting edge are directly integrated into the fuse housing in a space saving manner.

In FIG. 9, a cutting element having two offset cutting edges 4A is illustrated in cross-section, which cutting element enables the cutting of two fusible conductors 1A at a short stroke path.

According to FIG. 10, in each case a cutting edge 4A or an actuator 5A for cutting a fusible conductor 1A is used. This enables short stroke paths, an opposing movement of the cutting edges, and, with a corresponding design, a partial gap formation directly between the cutting edges 4A, if no additional isolating gap with or without extinguishing function or an area including an extinguishing medium is provided.

In FIG. 11, a cutting element having two cutting edges 4A and rotatory movement is illustrated, which can be forced by a corresponding guide and only one actuator. The cutting edge 4A may be guided in each case in one part such that a good gap formation is possible.

FIG. 12 shows an embodiment, in which a further fusible conductor 13A of the fuse, which may even be configured in a wire form, for example, will not be interrupted by the disconnection device.

The wire may be contacted to the main connections or else directly or indirectly to the main fusible conductors.

The wire is preferably surrounded by an extinguishing medium 14A. In case of the main fusible conductor being interrupted, the current will commutate to the wire, whereby an arc formation in the cutting area can be largely prevented and high dielectric strength can be realized after complete disconnection.

The interruption is performed by a further fusible conductor, which has a very low fuse current rating, in particular below the rate amperage of the network.

The fusible conductor 13A, which is in the form of a wire, for example, may be interrupted in a time-delayed manner by the same cutting edge, where appropriate, directly or indirectly, if necessary, in order to enable a passage of current at 0 A. An indirect interruption is possible in a mechanical displacement or destruction of a carrier on or by the wire. As an alternative to a wire, it is possible to realize a fusible conductor on a carrier 15A according to FIG. 13. A shift of an SMD fuse is likewise feasible.

With further modifications, the explained basic arrangement is suitable for interrupting high short-circuit currents.

The cutting or separating unit according to the invention may be in parallel to a horn spark gap 16A which is short-circuited by a fuse wire 17A of low fuse current rating, for example. When the main fusible conductor is ruptured, the current will commutate to the fuse wire 17A, which will ignite the horn spark gap 16A, which horn spark gap in turn extinguishing the current in an arcing chamber 18A in a current limiting manner.

Such an arrangement is exemplified in FIG. 14.

Here, the requirements regarding the current commutation and the risk of re-ignition here are lower than in a parallel connection to a fuse of small fuse current rating. Igniting an electric arc directly below the inlet area or else directly in an arc chamber is also possible. The requirement regarding current commutation and re-ignition is in this case already higher than in the classical horn spark gap, but is lower than in a parallel fuse of a fuse current rating. In such arrangements, the areas adjoining the cutting device and being filled with extinguishing medium may be dispensed with, whereby the impedance and the space requirement in the main path are reduced.

In a further design, the cutting device 4A may be located directly in the ignition range of a horn spark gap 16A. The horn spark gap 16A is in this case short-circuited by a fuse strip 1A, if necessary, having a bottleneck or a defined $I^2t$ value, and is located directly in the main path.

The fuse strip may be guided here outside the cutting area between the diverging electrodes.

The cutting or separating edge is in this case designed such that the electric arc developing upon interruption of the strip is moved in the direction of the arcing chamber, and an isolation distance is formed in the horn spark gap corresponding to the desired dielectric strength according to FIG. 15.

For this purpose, the cutting edge is manufactured at least predominantly from isolating material or mounted or embedded in isolating material.

After cutting the fusible conductor, the cutting edge is continued to be guided for several millimeters, so that the distance between the cut fusible conductor remainders is more than 3 mm, however, preferably more than 5 mm.

In addition, the cutting edge may be guided laterally next to the diverging electrodes of the horn spark gap in grooves 19A made of isolating material, whereby a lateral arc flashover will be prevented.

Apart from the activation by the actuator 5A, it may be provided in addition for the fusible conductor to be thermally separated or displaced from the area between the two electrodes such that an isolating gap is formed. The cutting edge may in this case be provided additionally with a mechanical pre-tension allowing the entry into the area of the diverging electrodes even without activation by the actuator. Such embodiments are known from the field of disconnecting devices for varistors, among others.

The explained arrangements and embodiments may be operated also by means of other internal or external actuators.

Arrangements including spring energy stores are possible here, as well.

FIG. 16 shows an arrangement having an actuator 5A with a short, yet variable stroke path. As the actuator, piezoceramics or similar may be used here, for example.

The fusible conductor 1A is in this case guided transversely in two isolation members 20A of punch-like formation. Due to the movement of the actuator, it is possible for a defined modulation of the bottleneck 3A of the fusible conductor to be performed even after the installation, and thus to change the characteristic of the fuse optionally. With a corresponding level of the signal to the actuator 5A, it is even possible to cut through the fusible conductor completely.

In case of a plurality of fusible conductors, the cutting and embossing of the bottleneck may be performed by several actuators according to the number of fusible conductors or also for several bottlenecks per fusible conductor. This results in the possibility to modify structurally identical fuses for different applications after their manufacture. The punching or embossing parts preferably are made of a material supporting the arc extinction, for example, ceramics, polymer or similar. In the case of very fine, granular extinguishing media, the punching area may be isolated from the extinguishing medium region in addition by isolating plates 9A. In thinner fusible conductors 1A, this isolation is not mandatory in case of a corresponding granulation of the extinguishing medium.

The activation of the fuse according to the invention depends on the selected actuators. The activation may be performed in shape memory alloys or bridge igniters via a current, for example. The current may be obtained, for example, from the connected network or a separate energy storage. In bridge igniters, the low required energy may also be provided in a galvanically separated way by a transmitter.

The triggering degree for the activation of the fuse will be designed such that activation is possible by means of several criteria. Here, actively controllable switches may be employed, which dispose of internal evaluation electronics or an external control option. In the simplest case, these switches may also be means responding directly to physical parameters, which means are provided in parallel to the controllable switch. Such switches may respond to threshold values or changes in temperature, pressure, current, voltage, optical signals, volume or similar or combinations thereof. As the switches, electronic, mechanical, voltage switching but also impedance-changing components can be employed.

FIG. 17 of a further embodiment of the invention shows a fusible conductor 1B having usual bottlenecks 2B in the form of oblong recesses. Between these usual recesses, an area having an unreduced cross-section 3B is provided, which in this case is of a similar length as the recesses. Within this area, an exemplary embodiment of an additional mechanical bottleneck 4B is formed. This bottleneck 4B is realized as a rhombus-shaped recess of short total length.

In particular, in the utilization of the fuse according to the invention in the shunt arm, such a design has the advantage that in the event of short-circuit loads, no additional arc voltage will be caused by a simultaneous arc development regarding the additional or known bottlenecks, whereby the voltage acting upon the loads to be protected remains controllable.

The short bottleneck may be realized without any considerable expansion of the fusible conductor and without any relevant reduction of the material of the fusible conductor, which is necessary for a controlled arc extension. Due to the explained design, the bottleneck will not result in an additional pressure or temperature load of the fuse housing either.

The relatively central position of the additional mechanical bottleneck that is surrounded by extinguishing medium, for example, usual quartz sand, results in a comparatively high extinguishing capability during the destruction of the bottleneck, since apart from the good cooling and the mechanical extension, an extension of the arc on both sides up into the area of the normal bottlenecks may take place quite rapidly due to the arc erosion.

Basically, the mechanical tensile bottleneck may also be provided at other positions of the fusible conductor, such as, for example, immediately before the first electrical bottleneck in the direction of tension of the actuator. It must, however, be observed that the free length of the fusible conductor in the region filled with extinguishing medium possibly must be extended according to the desired actively switchable short-circuit currents. It is consequently not mandatory for the mechanical bottleneck to be centrally situated in the fusible conductor.

The aforementioned allows the fuse, even if only one bottleneck is disconnected, to be activated already at high currents with virtual melting times of <10 ms. Thus, the fuse according to the invention is allowed to be interrupted after a shorter time in a virtually currentless state at low currents far below the rated amperage and even high fault currents in the kA ampere range. Also, an almost arbitrary time/current characteristic may be realized depending on the requirement.

As an alternative to a free routing of the fusible conductor and a tensile action upon the entire fusible conductor, tension relief means on the fusible conductor or partially fixing the fusible conductor in so-called "stone sand" are also possible. Thus, the force may be directed to a single bottleneck in a targeted manner.

When coarse or angular extinguishing sand is used, it may be expedient for the usual normal electrical bottlenecks between the actuator and the mechanical tensile bottleneck to be provided with isolating foil, for example, so that additional friction is reduced.

FIG. 18 shows a fusible conductor 1B for a capsule fuse having bottlenecks 2B, which, for achieving short melting times at small overcurrents, are designed to be longer than usual bottlenecks. The distance of the unreduced cross-section 3B of the fusible conductor between the bottlenecks, however, corresponds in this case to at least the length of the bottleneck.

This already results in an advantageous decrease of the fuse current rating of the fuse. In an active fuse, the elongation of these bottlenecks is increased upon tensile load, and the requirements concerning the mechanical additional bottleneck grow. In order to achieve optimum extinguishing properties with a simple quartz sand filling, splitting the fusible conductor into a plurality of fusible conductors is advantageous with high pulse currents to be overcome and the high metal content associated therewith. Two fusible conductors of identical design are advantageous here.

FIG. 19 shows an embodiment in which the further mechanical bottleneck 4B according to the invention is introduced between the normal bottlenecks 2B. This bottleneck of a length of ideally a few 10 μm is unsuitable as a usual bottleneck and does not support the passive function thereof in the event of short-circuit disconnections. Despite a smaller cross-section, the bottleneck will not respond at these loads, whereby no additional arc voltage is generated. The function accordingly is solely restricted to the active control of the fuse.

The length of the bottlenecks is designed by the factor 4, ideally, however, greater than 10, to be smaller than the lengths of the usual known bottlenecks.

In a mechanical bottleneck of a maximum length of 500 μm, for example, the usual known bottlenecks are longer than 4 mm. Better relationships result at a length of <150 μm up to lengths of >2 mm in usual known bottlenecks.

The cross-section of the bottleneck according to the invention is smaller by at least the factor 20%, ideally more than 50% smaller than that of the normal bottleneck. The usual, normal known bottlenecks have a modulation degree of about 2 with respect to the unreduced cross-section. This relatively low modulation degree is expedient due to the necessary low metal content in small constructional sizes.

For small constructional fuse sizes, copper or copper alloys are usually used due to the limitation of the relationship between the material of the fusible conductor and the extinguishing medium for the fusible conductor.

The tensile force of the bottlenecks required for them to be ruptured is at most 80%, however, ideally <60% with respect to the forces resulting in rupturing normal bottlenecks.

Until the rupturing of the mechanical bottleneck, an expansion of the entire fusible conductor takes place in case of soft copper by at most 3 mm, preferably less than 1 mm. This corresponds to <5% of the entire length of the fusible conductor.

In case of copper, an expansion of about 40% is needed up to the rupturing of the mechanical bottleneck when it is in a rhombus-shape. Even at an individual length of 4 mm, the usual bottlenecks hereby expand in total only by <8%, the unreduced cross-section of the fusible conductor only expands by a value of <1%. In shorter bottlenecks, the expansion may be restricted even more to the mechanical bottleneck despite the force acting upon the entire length of the fusible conductor. This allows a complete integration into a usual small constructional size of the fuses even if the material is inconvenient.

The possible stroke path within the fuse is delimited to at least twice the path required for reliably rupturing the mechanical bottleneck, and is designed correspondingly. The path, however, may also be designed to be longer in order to achieve sufficient dielectric strength.

By delimiting the tensile force to only one area of the fusible conductor having the mechanical bottleneck, the expansion may be further reduced.

FIGS. 20*a* to 20*c* show design variants of the additional mechanical bottleneck.

In FIG. 20*a*, a fusible conductor 1B having four normal bottlenecks 2B and a modulation degree of 2 is illustrated. The length of the bottlenecks is 4 mm, whereby the rated amperage may already be reduced to about 160 A. The heating of the bottlenecks at a load of 25 kA 10/350 μs is about 700° C., with a sufficient ageing stability being still given here. The mechanical predetermined breaking point 4B is dimensioned so as to be able to be produced by simplest punching methods and, at the same time, having the normal known bottlenecks. The length is 0.5 mm, for example. The cross-section of the transversely arranged oblong holes, however, is reduced by 20% as compared to normal bottlenecks. In case of pulse loads, the temperature of this bottleneck is level with the temperature of the remaining bottlenecks.

In FIG. 20*b*, a bottleneck 4B of equal entire length but having a rhombus-shaped geometry is illustrated. The rhombuses shorten the area of the minimum residual cross-section with respect to the overall length significantly. In terms of the remaining bottlenecks, the residual cross-section may be reduced at the same temperature to 60%. The reduction of the force needed to destroy the mechanical bottleneck is in the same range. The design of such bottlenecks or similar bottlenecks is solely restricted by the technology and the cost of reproducible manufacture.

According to FIG. 20*c*, a design of a bottleneck 4B restricted to thickness modulation may be performed. In this representation, the fusible conductor 1B is not shown in a top view of the width of the fusible conductor. The view is related to the thickness of the fusible conductor 1B in a side view. By a uniform, both-sided modulation over an overall short length of the bottleneck 4B of, for example, only 50-150 μm, the cross-section and the needed force may be reduced with respect to normal bottlenecks to about 40% at the same heating in case of pulse currents. In the illustrated FIG. 20*c*, the residual thickness, which is uniform over the width of the fusible conductor, is approximately only one third of the overall length of the bottleneck.

The variant according to FIG. 20*c* discloses a design allowing a sufficient and uniform current density distribution in case of pulse currents with a very strong cooling of the bottleneck. The heating of the bottleneck in case of pulse currents, despite of the smaller residual cross-section and sufficient force reduction, may thus be even significantly below that of normal bottlenecks, if this is advantageous for the entire function. The assumed identical temperature increase in case of pulse currents, in case of which the response of the bottlenecks should be avoided, results in higher temperatures at the normal bottlenecks in case of mains frequency currents, whereby, when the behavior is passive, an arc formation at the traction bottleneck may be avoided. At a load with a short-circuit current of about 4 kA and a virtual meting time of about 10 ms, the temperature at the traction and tension bottleneck is only 211° C. (T0=22° C.), when the melting temperature is reached at the usual known bottlenecks.

In FIGS. 21*a* and *b*, an exemplary structure of an NH fuse in a capsule design is illustrated in sections. FIG. 21*a* shows in this case the normal state, and FIG. 21*b* shows the triggered state.

The fuse preferably has an isolating housing 5B, two main fusible conductors 1B, on both sides for connecting in each case a metallic end cap 6B, to which the fusible conductors 1B are contacted.

For activating the igniter 7B, the fuse in a small constructional size exhibits an outlet for at least one or two control terminals 8B. The control terminals 8B may be guided out axially, but also radially from the housing or the end caps of the fuse. In case of larger outlets, wireless activation is also possible.

The igniting means formed, for example, as a bridge igniter 7B, is situated in a small hollow space 9B and surrounded by a projectile 10B, which is guided in a kind of piston 11B. At the projectile 10B, two fusible conductors 1B each are in this case rigidly connected to a central mechanical bottleneck 4B.

The connection may in this case be performed in a form-fitting or force-fitting manner, for example, by soldering, welding or clamping.

Preferably, the fusible conductors are clamped under pressure between a conical area of the projectile 10B and a further conical part 12B. When, during the activation of the bridge igniter 7B, force is applied to the projectile 10B, the clamping force continues to increase, so that it is not possible to release the clamping connection. In case of a small constructional space, the parts may be shaped to be cylindrical, and the fusible conductors may be shaped as half shells.

Below the piston 11B, the fusible conductors are situated in a space 13B filled with extinguishing medium. Quartz sand is preferably employed as the extinguishing medium. All of the bottlenecks of the fusible conductors preferably are surrounded by the extinguishing medium.

The piston 11B is situated in an intermediate part 14B, which delimits the space including the extinguishing medium from a hollow space 15B above the projectile 10B.

The intermediate part 14B may be an isolating part or even be made partially or completely from an electrically conducting material.

The intermediate part 14B may be designed to be bowl-shaped, and may rest upon the housing part 5B via a rim.

Between the intermediate part 14B and the end cap 6B, a substantially annular part 16B may be provided to which the fusible conductors 1B are contacted through the end cap 6B.

A current flow between the fusible conductors 1B and the end cap 6B through the intermediate part 14B may be prevented, if necessary, by a suitable material selection or an isolating layer.

The end cap 6B and the parts 5B and 14B, as well as 16B are designed such that the fuse is finally closed by pressing on the end cap 6B.

In the area of the part 14B below the piston 11B, a sealing effective against the extinguishing medium is made, which, even when the fusible conductor moves, does not allow any unsealing of the extinguishing medium.

The two fusible conductors 1B are realized above the piston 11B and the projectile 10B in the extinguishing medium-free space 15B by areas angled with respect to the axis.

During the movement of the projectile 10B in the extinguishing medium-free space 15B, the sealing guidance between the projectile 10B and the piston 11B is only canceled after rupturing the fusible conductor at the mechanical bottleneck 4B.

FIG. 21*b* shows the disconnected state.

The angled areas of the fusible conductor are bent during the movement in the extinguishing medium-free space quasi in the opposite direction at a minimum effort. The bending of the strips requires no pressure compensation in a small volume without extinguishing medium, since the air displacement does not take place against a closed space. It is advantageous in this embodiment, that no additional interruption or contacting of the fusible conductor(s) is necessary for contacting the fusible conductors and the extension of the isolating gap.

The fusible conductor strips that are employed by way of example may be guided through the fuse on a short path at very low impedance and without deviations or movements. As a whole, a fusible conductor material of very low impedance despite the relatively high elongation at break of such materials is employed. The impedance of the arrangement is low, so that in case of a high current slope and high currents, the ohmic and inductive voltage drop across the fuse, and thus the influence on the protective level of the arrangement is low. In case of 25 kA 8/20 μs pulses, the voltage drop is <300 V, preferably less than 200 V.

As an alternative to the explained arrangement, the projectile may even be connected directly or indirectly to the connection caps by a transverse connecting strip, a flexible line, a multiple contact system or similar. The area of the fusible conductor ends in this case at the projectile.

When shape memory alloys or volume changing materials are used, a similar structure as that described above may be used, wherein the sealing between the projectile and the piston may be dispensed with. In the event of use of shape memory alloys, an embodiment according to FIGS. 22*a* and 22*b* is also possible when the tensile force is utilized.

In FIGS. 22*a* and 22*b*, only a segment of the structure is illustrated in detail for the purpose of explanation. The position of the segment within the outlined fuse 17B in capsule design is demonstrated by dashed areas.

For reasons of simplification, the operating mode according to FIGS. 22*a* and 22*b* is explained only on the basis of one fusible conductor 1B. The fusible conductor 1B has a substantially U-shaped portion 18B. The fusible conductor itself is guided through two plate-like feedthroughs 19B and 20B.

The feedthrough is realized, for example, as a first fixed plate 19 and is situated in the area of the U-shaped portion of the fusible conductor. The second plate 20B is movable and situated in the transition area to an axial fusible conductor area. Between the two plates, the fusible conductor extends to the second plate 20B at an acute angle.

Downstream of the U-shaped area and the second plate 20B, as well as of a further plate 21B for isolating against the extinguishing medium, the mechanical additional bottleneck 4B is situated. An extinguishing medium and a bottleneck are not present between the two plates in the fuse.

When a tensile force in the direction of the U-shaped deviation is applied to the second plate 20B, the tensile force will act directly upon the mechanical bottleneck 4B as a tearing fore. The tensile force may also be realized by a shape memory element 22B attached directly or indirectly to the second plate, for example, by heating it directly or indirectly.

The plates 21B and 19B seal off the U-shaped area of the fusible conductor including the movable plate 20B from the ingress of extinguishing medium.

The areas 23B and 24B are filled with extinguishing medium.

The majority of the usual bottlenecks of the fusible conductor are situated in the area 23B. The mechanical bottleneck 4B is situated in the area 24B. FIG. 22*a* shows the described arrangement during normal operation, and FIG. 22*b* shows the state after a bottleneck interruption.

When the plate 19B is pulled, it will exert a pressing action upon the area of the U-shaped fusible conductor routing. The fusible conductor is thereby clamped between the plates, and a further movement results in an immediate load upon the mechanical bottleneck with a sufficient tensile force, which overloads the mechanical bottleneck 4B.

The activation of the fuse depends on the selected actuators. The activation may be performed, for example by means of shape memory alloys or in the bridge igniters via a current. The current may be obtained from the connected mains or else from a separate storage. In a bridge igniter, here, as well, the possibility is given to provide the needed energy in a galvanically isolated manner by a transmitter.

The triggering circuit for the activation is realized such that the activation may be performed by means of several criteria. As already discussed, actively controllable switches or even switches immediately responding to physical parameters may be employed.

Applying a tensile force to the fusible conductor situated in the extinguishing medium, for example, quartz sand, is also possible with permanent spring force. In an embodiment according to FIG. 23, it is not a tensile force which is brought to act upon the mechanical bottleneck but a tensile force is brought to act upon a solder joint, which can be disconnected by a reaction foil (exothermal reaction) within 1 ms. The extension requires a stroke path which comprises the length of the soldering distance and the needed isolating distance.

According to FIG. 23, the fuse has a housing 5B with connection caps 6B. The fusible conductor 1B is split into two areas, which are interconnected by solder 25B. In the area of the connection, the reaction foil 26B of exothermal heat generation is arranged. The reaction of the foil may be triggered via an auxiliary fuse or a spark generator 27B. The control is performed in this case via one or two connection lines 8B. The connection point is situated in the area of the fuse including extinguishing medium 13B. This area is sealed off from the extinguishing medium-free area 15B by a feedthrough 28B. In this area, a spring 29B mechanically pretensioning the fusible conductor 1B is situated. After the solder connection 25B has been disconnected, the fusible conductor 1B is kinked (dashed position) and pulled through the area 15B, so that a sufficiently long isolating distance between the two remainders of the fusible conductor is yielded.

The invention claimed is:

1. A triggerable melting fuse for protecting one or more devices that are connectable to a power supply system consisting of at least one fusible conductor which is located between two contacts and is arranged in a housing, and also consisting of a trigger device for controlled disconnection of the at least one fusible conductor in the event of malfunctions or overload states of the connected one or more devices, wherein an extinguishing medium is introduced into the housing, wherein the at least one fusible conductor has a plurality of electrical bottlenecks, which are designed for a rated load of the triggerable melting fuse, wherein at least one further additional geometric bottleneck is provided, which is disconnectable by rupturing depending on the trigger device when applied by tension, wherein the at least one further additional geometric bottleneck despite the smaller cross-section at identical current load will not respond before the plurality of electrical bottlenecks at all current loads, but will respond in a time-delayed manner or at higher loads, and wherein the trigger device is adapted to rupture the fusible conductor in the event of malfunctions or overload states by applying a force along the entire length of the fusible conductor such that the at least one further additional geometric bottleneck is ruptured.

2. The triggerable melting fuse according to claim 1, wherein the at least one geometric bottleneck has a residual cross-section, which is smaller than a residual cross-section of the electrical bottlenecks.

3. The triggerable melting fuse according to claim 1, wherein the trigger device controls an actuator.

4. The triggerable melting fuse according to claim 3, wherein the actuator is comprised of a piston, the movement of which is triggered by a bridge igniter.

5. The triggerable melting fuse according to claim 4, wherein the bride igniter is situated in a hollow space and is surrounded by a projectile, which is guided in a piston.

6. The triggerable melting fuse according to claim 5, wherein two fusible conductors each are rigidly connected to a central mechanical bottleneck at the projectile.

7. The triggerable melting fuse according to claim 3, wherein the actuator causes a defined expansion of the at least one fusible conductor after the at least one fusible conductor has been ruptured, such that a developing entire isolating distance realizes a dielectric strength of at least 2.5 kV.

8. The triggerable melting fuse according to claim 1, wherein the number of the plurality of electrical bottlenecks corresponds to the rated voltage of the triggerable melting fuse.

9. The triggerable melting fuse according to claim 1, wherein the at least one further additional geometric bottleneck is provided between the plurality of electrical bottlenecks.

10. The triggerable melting fuse according to claim 1, wherein the triggerable fuse is based on a defined rupturing of the at least one further additional geometric bottleneck of the at least one fusible conductor in the extinguishing medium after activation of a trigger.

11. The triggerable melting fuse according to claim 1, wherein the at least one further additional geometric bottleneck is a geometric predetermined breaking point.

12. The triggerable melting fuse according to claim 11, wherein the additional geometric bottleneck is a tensile bottleneck.

13. The triggerable melting fuse according to claim 1, wherein the integral value of the at least one further geometrical bottleneck in the period of transient pulse current loads is identical or even greater than that of the plurality of electrical bottlenecks.

14. The triggerable melting fuse of claim 13, wherein the at least one further geometrical bottleneck has a residual cross-section which is smaller than that of the electrical bottlenecks.

15. The triggerable melting fuse according to claim 1, wherein a mechanical strength of the at least one further geometrical bottleneck relative to the force direction of the actuator is lower than the mechanical strength of the electrical bottlenecks.

16. The triggerable melting fuse according to claim 1, wherein the at least one further geometrical bottleneck is of a smaller design than the electrical bottlenecks.

17. The triggerable melting fuse according to claim 1, wherein the length of the at least one further geometrical bottleneck is designed to be smaller than the length of the electrical bottlenecks by a factor 4.

18. The triggerable melting fuse according to claim 1, wherein the length of the at least one further geometrical bottleneck is designed to be smaller than the length of the electrical bottlenecks by a factor greater than 10.

19. The triggerable melting fuse according to claim 1, wherein the at least one further geometrical bottleneck is unsuitable as the plurality of electrical bottlenecks.

20. A triggerable melting fuse for protecting one or more devices that are connectable to a power supply system consisting of at least one fusible conductor which is located between two contacts and is arranged in a housing, and also consisting of a trigger device for controlled disconnection of the at least one fusible conductor in the event of malfunctions or overload states of the connected one or more devices, wherein an extinguishing medium is introduced into the housing, wherein the at least one fusible conductor has a plurality of electrical bottlenecks, which are designed for a rated load of the triggerable melting fuse, wherein at least one further additional geometric bottleneck is provided, which is disconnectable by rupturing depending on the trigger device when applied by tension, wherein the at least one further additional geometric bottleneck despite the smaller cross-section at identical current load will not respond before the plurality of electrical bottlenecks at all current loads, but will respond in a time-delayed manner or at higher loads, and wherein the at least one fusible conductor, when not being ruptured, has an angled area with respect to a length axis of the at least one fusible conductor, the angled area being adapted to be bent when the at least one further additional geometric bottleneck of the at least one fusible conductor is being ruptured.

21. A triggerable melting fuse for protecting one or more devices that are connectable to a power supply system consisting of at least one fusible conductor which is located between two contacts and is arranged in a housing, and also consisting of a trigger device for controlled disconnection of the at least one fusible conductor in the event of malfunctions or overload states of the connected one or more devices, wherein an extinguishing medium is introduced into the housing, wherein the at least one fusible conductor has a plurality of electrical bottlenecks, which are designed for a rated load of the triggerable melting fuse, wherein at least one further additional geometric bottleneck is provided, which is disconnectable by rupturing depending on the trigger device when applied by tension, wherein the at least one further additional geometric bottleneck despite the smaller cross-section at identical current load will not respond before the plurality of electrical bottlenecks at all current loads, but will respond in a time-delayed manner or at higher loads, and wherein the trigger device controls an actuator, the actuator being comprised of a piston, the movement of which is triggered by a bridge igniter, wherein the bride igniter is situated in a hollow space and is surrounded by a projectile, which is guided in a piston, and wherein the at least one fusible conductor is clamped under pressure between a conical area of the projectile and a further conical part of the projectile.

* * * * *